US009318087B2

(12) United States Patent
Solow

(10) Patent No.: US 9,318,087 B2
(45) Date of Patent: Apr. 19, 2016

(54) ELECTROPNEUMATIC HORN SYSTEM

(71) Applicant: Stanley Solow, Plainview, NY (US)

(72) Inventor: Stanley Solow, Plainview, NY (US)

(73) Assignee: WOLO MFG. CORP., Deer Park, NY (US)

( * ) Notice: Subject to any disclaimer, the term of this patent is extended or adjusted under 35 U.S.C. 154(b) by 124 days.

(21) Appl. No.: 14/080,879

(22) Filed: Nov. 15, 2013

(65) Prior Publication Data

US 2014/0093112 A1 Apr. 3, 2014

Related U.S. Application Data

(63) Continuation-in-part of application No. 13/297,955, filed on Nov. 16, 2011, now Pat. No. 8,687,835.

(51) Int. Cl.

| | |
|---|---|
| ***G10K 9/04*** | (2006.01) |
| ***H04R 1/00*** | (2006.01) |
| ***G10K 9/12*** | (2006.01) |
| ***G10K 9/22*** | (2006.01) |
| ***H04R 1/30*** | (2006.01) |
| *H04R 1/02* | (2006.01) |

(52) U.S. Cl.

CPC .. *G10K 9/04* (2013.01); *G10K 9/12* (2013.01); *G10K 9/22* (2013.01); *H04R 1/00* (2013.01); *H04R 1/30* (2013.01); *H04R 1/023* (2013.01); *H04R 2499/13* (2013.01)

(58) Field of Classification Search

CPC ..... G10K 9/02; G10K 9/04; G10K 9/12; G10K 9/18; G10K 9/20; G10K 9/22; H04R 2499/13; H04R 1/30; H04R 1/2861

USPC ..... 381/340, 86, 335, 386, 389; 116/142 R, 116/137 R, 142 FP, 59; 340/391.1, 388.1, 340/384.1, 404.1; 181/152, 159, 179, 144

See application file for complete search history.

(56) References Cited

U.S. PATENT DOCUMENTS

| | | | | |
|---|---|---|---|---|
| 1,941,073 | A * | 12/1933 | Blattner | 381/165 |
| 2,084,944 | A * | 6/1937 | Cornwell | 381/351 |
| 2,173,951 | A * | 9/1939 | Patterson | 116/142 FV |
| 2,921,554 | A * | 1/1960 | Irwin | 116/142 R |
| 7,038,576 | B2 * | 5/2006 | Di Giovanni et al. | 340/404.1 |
| 7,938,078 | B2 * | 5/2011 | Solow | 116/142 FP |
| 2004/0113758 | A1 * | 6/2004 | Neft | 340/388.1 |
| 2004/0246110 | A1 * | 12/2004 | Di Giovanni et al. | 340/388.1 |

(Continued)

*Primary Examiner* — Curtis Kuntz
*Assistant Examiner* — Joshua A Kaufman
(74) *Attorney, Agent, or Firm* — Andrew F. Young, Esq.; Lackenbach Siegel, LLP

(57) ABSTRACT

An electropneumatic horn assembly for generating sound may include a compressor unit, a compressor housing assembly, and a sound generating assembly. The compressor housing assembly may have a base portion and a movable cover portion, which may movably engage with the base portion to provide access to the compressor when in an open position and to provide a sealed bonding interface when in a closed position. The sound generating assembly may include a diaphragm and a horn duct housing. A plurality of vents may be embedded in the cover portion for venting air adjacent to an outer face of the compressor unit. A spacer may be positioned between an inner wall of the cover portion and an outer face of the compressor unit to provide an air channel therebetween. The cover portion and the base portion may comprise respective engagement means for securely affixing the cover portion to the base portion around the compressor unit to maintain operational stability of the horn assembly.

17 Claims, 14 Drawing Sheets

(56) References Cited

U.S. PATENT DOCUMENTS

2009/0065291 A1* 3/2009 Solow ..... 181/152
2009/0090292 A1* 4/2009 Solow ..... 116/142 FP
2010/0175609 A1* 7/2010 Solow ..... 116/142 FP
2013/0121521 A1* 5/2013 Solow ..... 381/340
2014/0093112 A1* 4/2014 Solow ..... 381/340

* cited by examiner

Fig. 1
(Prior Art)
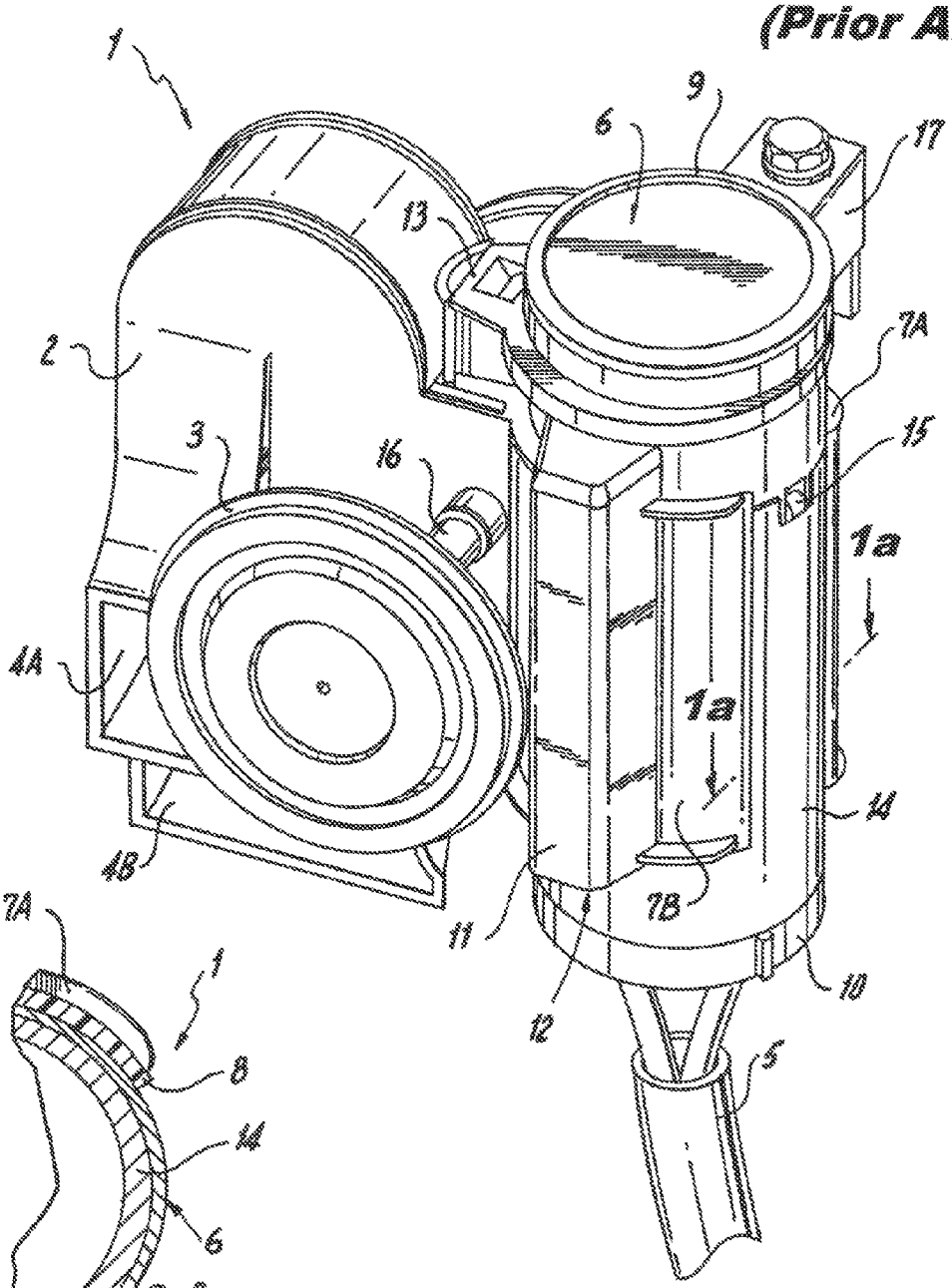
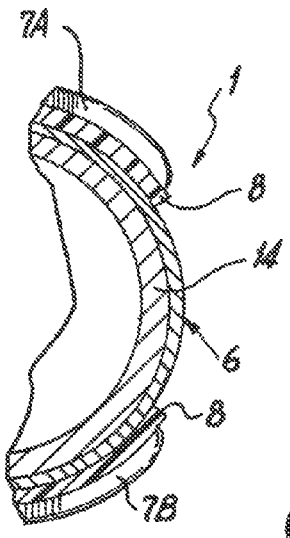
Fig. 1a
(Prior Art)

340, 344
340, 344

309
213
213A
215
211B
214
325A
306
102'
113B
340
330
307, 307A
341, 342
330
111B
103
316
330
330
111
300
111A
104A
104B
112
105
120
120
124
126'

Fig. 11
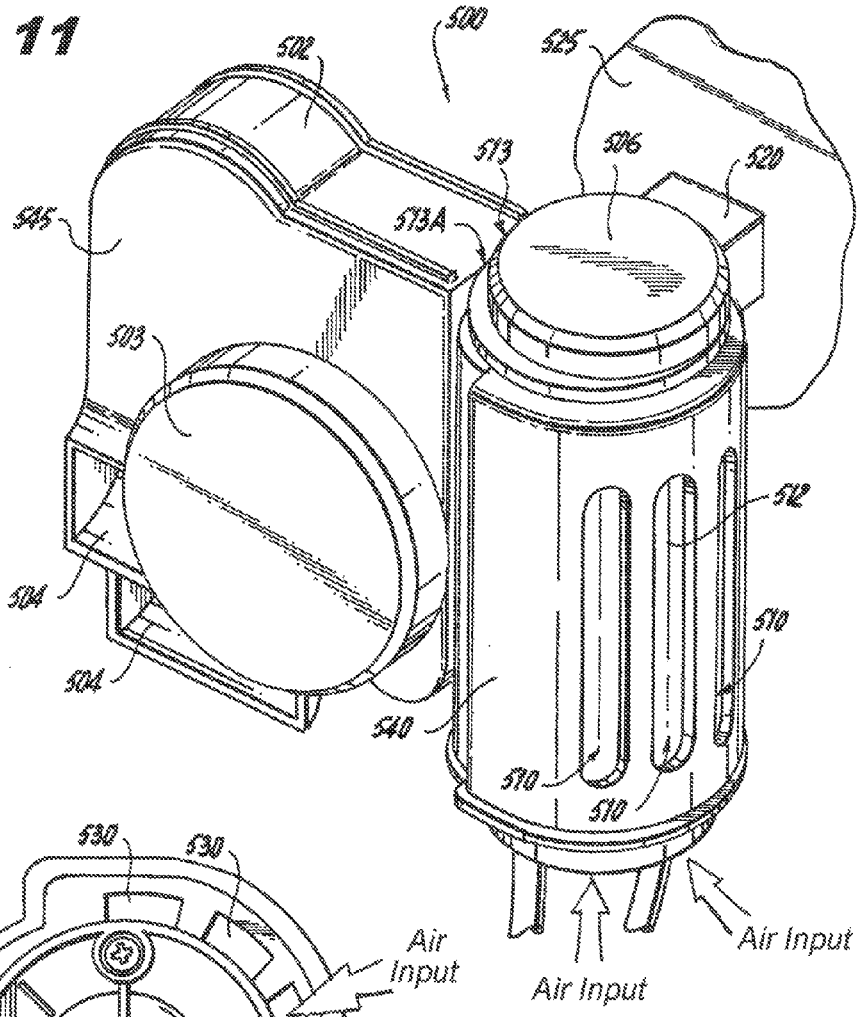
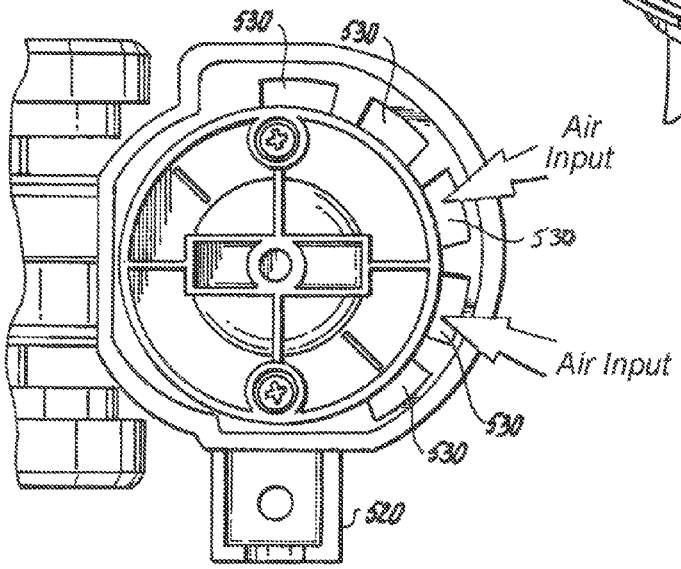
Fig. 12

Fig. 13
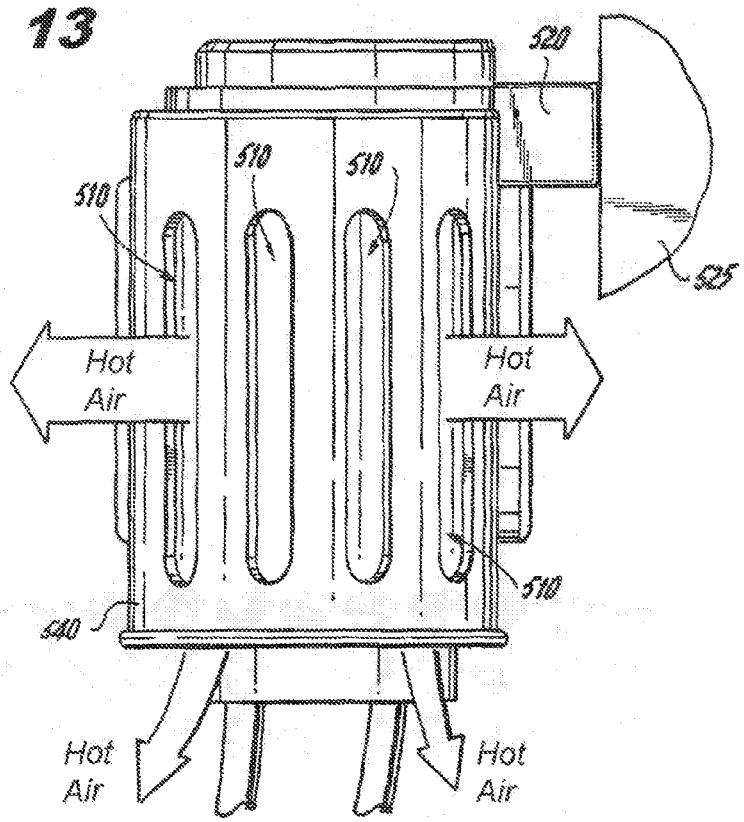
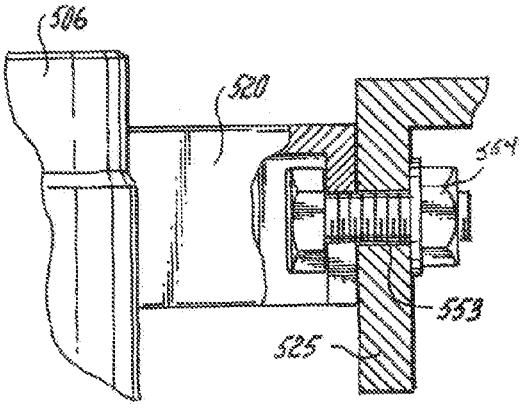
Fig. 14
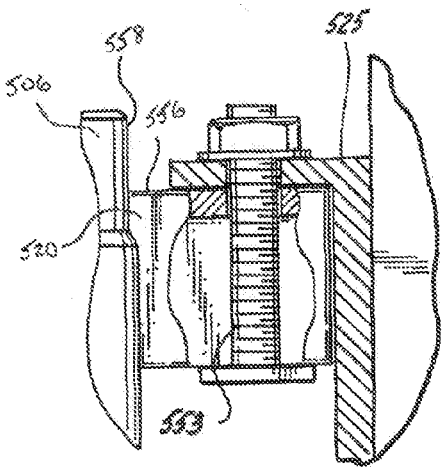
Fig. 15

Fig. 16
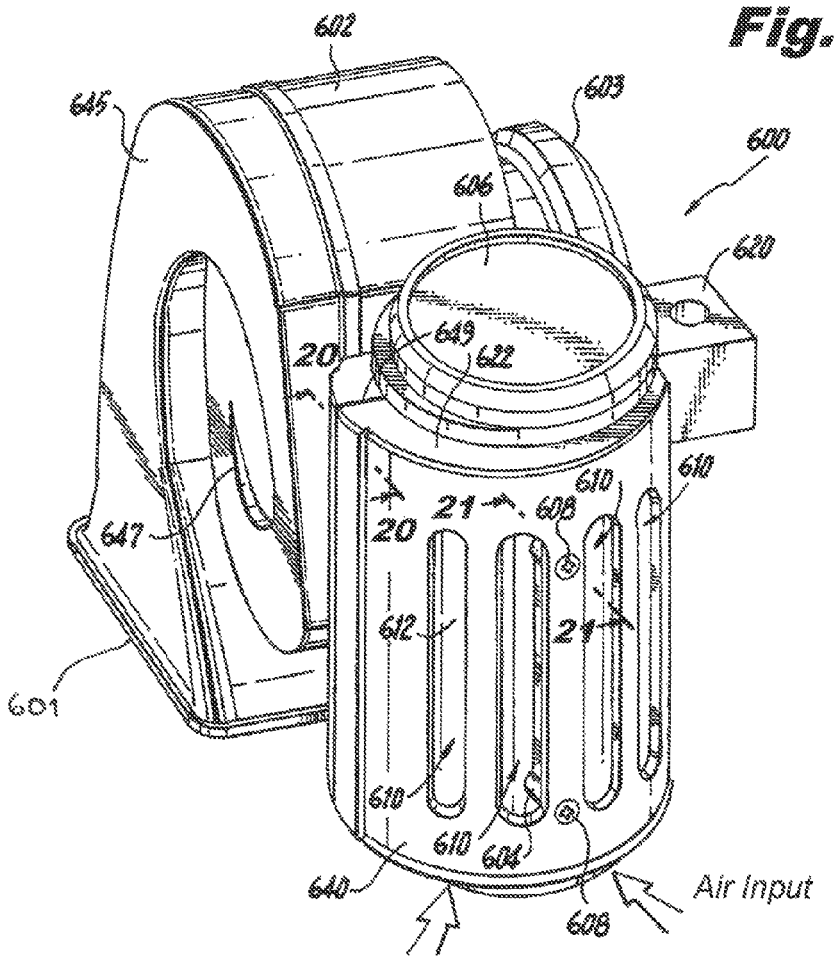
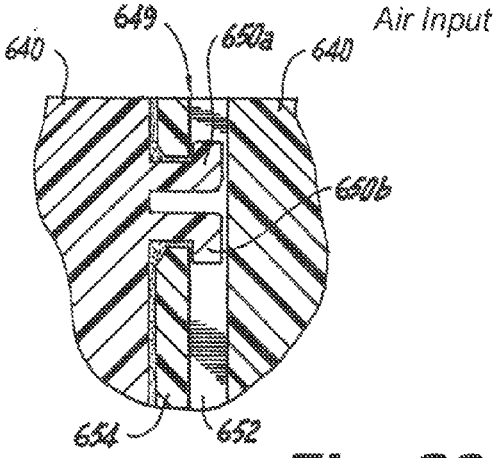
Fig. 20
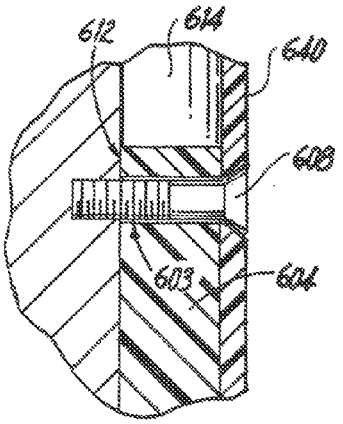
Fig. 21

ELECTROPNEUMATIC HORN SYSTEM

CROSS REFERENCE TO RELATED APPLICATIONS

This application is a continuation-in-part application of and claims priority from U.S. application Ser. No. 13/297,955 filed Nov. 16, 2011, the entire contents of which are incorporated herein by reference, which claims priority from U.S. Provisional Application Ser. No. 29/402,821 filed Sep. 28, 2011, the entire contents of which are incorporated herein by reference. This application also relates to and incorporates herein fully by reference the entire contents and disclosures of U.S. Provisional Application Ser. No. 60/970,365 filed Sep. 6, 2007, U.S. Provisional Application Ser. No. 60/979,525 filed Oct. 12, 2007, U.S. Provisional Application Ser. No. 61/059,172 filed Jun. 5, 2008, U.S. application Ser. No. 12/183,826, filed Jul. 31, 2008, now U.S. Pat. No. 7,802,535, PCT Application Serial No. PCT/US08/71796 filed Jul. 31, 2008, U.S. Application Ser. No. 29/323,232, filed Aug. 21, 2008, now U.S. Pat. No. D581,305, U.S. application Ser. No. 12/332,868, filed Dec. 11, 2008, now U.S. Pat. No. 7,712,430, and U.S. application Ser. No. 12/732,367, filed Mar. 26, 2010, now U.S. Pat. No. 7,938,078.

FIGURE SELECTED FOR PUBLICATION

FIG. 16

BACKGROUND OF THE INVENTION

1. Field of the Invention

The present invention relates to an electric horn system. More specifically, the present invention relates to an improved compressor unit and monolithic housing assembly for an electropneumatic horn system to provide enhanced multi-tonal sound generation through improved air venting to take in air for compression while reducing pressure. Also, the present invention relates to an electropneumatic horn system adapted for multiple commercial uses wherein a compressed air generating unit is securely fixed within a monolithic housing during an assembly and enables multi-tonal, particularly bi-tonal sound generation, during a use. The compressed air generating unit has air venting channels to take in air for compression while reducing pressure.

2. Description of the Related Art

The related art involves generally electric and electropneumatic horn constructions and systems. Electropneumatic horns are those which generate sound by generated air flow or compressed air and are considered (very broadly due to their typical electrical operation of compressed air or air-supply valving) to be within the wider grouping of electric horns due to the electric control of the generation of the air flow or compressed air. It should be noted that electric horn constructions also include (in addition to pneumatic sound creation) the creation of electronic sound (e.g. speaker type systems) wherein sound or tone is the result of an electronic signal to a speaker and not the result of an acoustic passage. As a consequence, those of skill in the art will recognize that the use of the phrases electronic, electrical, and electropneumatic shall be considered non-limiting in the following description.

Conventionally, electropneumatic horns include acoustic units consisting of a straight exponential tube of a length related to the frequency to be reproduced, inserted in an acoustic chamber in which a membrane free to move with a reciprocating motion is arranged and positioned. Also, the straight tube comprises a first stretch with generally constant cross-section, provided with an inlet mouth for the sound signal generated by the oscillating membrane and a second stretch having a section varying with a generally conic exponential law ending with an cutlet mouth for the amplified sound signal (e.g., horn shaped).

As used in these conventional electropneumatic horns, the membrane is properly stretched or positioned during a pre-assembly calibration phase by deformation against the membrane of a member referred to as a 'sound generator' and applied to a chamber body, in such a way to generate a sound with manufacturer-desired predetermined acoustic pressure during a use. In an alternatively constructed versions of the related art, the acoustic units are paired (commonly bi-tonal), and the corresponding tubes are volute wound and juxtaposed to limit the overall dimensions of the horn allowing for reduced-size installations.

As already stated said acoustic horns and more particularly those with a straight acoustic tube (e.g., 'truck air horns'), equip motor vehicles and are generally installed in the engine compartments and on vehicle roofs. Acoustic horns with different features are available on the market, both by others and by the present Applicant, and are mainly classified according to the number of acoustic units, generally one to a general maximum of three tuned tonal sounds, each shaped according to the frequency that each unit should reproduce.

The need to optimize space and reduce dimensions of every element of the motor vehicle, has lead to the reduction in size of such electropneumatic acoustic horns generally, and the miniaturization of specific horn components. For example, it is known to reduce the size of the air compressor unit or member as well as reduce the overall size of the acoustic sound units.

Referring now to U.S. Pat. No. 7,038,756 to DiGiovani et al ('756), the entire contents of which are incorporated herein by reference, and FIGS. 1 and 1A (since the earlier proposed solutions had not garnered sufficient success), it has attempted to respond to the needs in the art by providing a dual tone or dual acoustic unit wherein a completed assembly 1 accommodates dual acoustic units having respective horn openings 4A and 4B within a relatively compact housing 2. In this related unit, housing 2 contains a single compressor unit, or compressor member 6 which is removably and slidably joined within an adjustable clamp to housing 2, and provides a compressed air supply via air supply outlet fixture 13 simultaneously to each acoustic unit within housing 2 via internal chambering.

As also noted, dual opposing diaphragm units 3 and 3 are shown and respectively receive, via internal chambering (not shown, but visible in the '756 patent) compressed air from compressor unit 6 via respective diaphragm air supply portals 16 and 16 (the reverse side is not shown). Diaphragm units 3 and 3, operate as sound generators and transmit the sound to the volute acoustic chambers respectively connecting each diaphragm unit 3 to respective horn openings 4A and 4B.

Compressor unit 6 consists of an operable motor housing member 14 formed from a very rigid metal body, a bottom electric brush housing member 10, wherein electrical power is received via power supply cords 5, and a top compressor labyrinth member 9. As will be noted from FIG. 1, rigid housing member 14 includes folded metal tabs 15 serving as engagement fingers joining motor housing 14 to top compressor labyrinth member 9 to prevent unintended separation and reliable operation. Typically, bottom electronic brush housing member 10 is secured to rigid housing member 14 via a plurality of removable and accessible snap-in fittings (not shown), allowing ease of assembly. Unfortunately, this ease of assembly also creates relative structural weaknesses in the overall completed assembly 1 that may serve as a source of future failure (as will be discussed).

Housing 2, includes a pair of opposing C-shaped plastic clamp arms 7A and 7B as shown for slidably and removably gripping portions of the external surface of rigid housing member 14. Additionally, an air tube member 11, having an air intake opening 12 is formed along the wall of the first clamp arm 71 and supplies air to a top air opening or inlet (not shown) in compressor to member 9. Additionally, a single mounting bracket member 17, extends rearwardly from compressor unit 6 and compressor pump member 9, allowing attachment to a weather-dry location within an inner vehicle wall mount position (not shown). As noted earlier, system 1 contains a number of relative structural weaknesses, and mounting bracket member 17 is a common location for structural failure. As can be recognized from the cantilever construction shown, mounting bracket 17 provides a single-site attachment mechanism, which tends to fail when used in high-vibration environments, including automotive and motorcycle mounting environments.

Additionally, it shall be recognized by those of skill in the art that opposing paired clamping arms 7A and 7B slidingly receive compressor unit 6, and consequently that even with air outlet fixture 13 providing an additional engagement with housing 2, the construction taught in '576 often results in mechanical failure causing separation of compressor unit 6 because there is no physical engagement between the body of the compressor unit 6 and housing 2 other than air outlet fixture 13, and, because there is no mechanism to maintain the tension between clamp arms 7A and 7B to ensure and maintain a clamping pressure, particularly during the thermal expansion common in plastic housings when employed in high temperature environments common in vehicle wall mounting positions. As a consequence of this tendency for mechanical failure, those who review the mechanical units marked with the '576 patent note the inclusion of an additional adhesive double-tape stick portion 8 between portions of clamp arm members 7A and 7B and portions of the wall surfaces of motor housing 14.

The use of such double-stick tape 8 is unfortunately also problematic since it does not address the initial structural design weakness in the engagement between housing 2 and compressor unit 6, and because such adhesive tape readily fails for a number of reasons, including: (a) degradation, melting, off-gassing, or embrittlement of the adhesive in high temp (>100 Celsius) and low temp (<0 Celsius) common in standard vehicle mounting environments or (b) mechanical failure of the tape backing structure itself. Since the related art recognizes the preferred use of unit 1 within the automotive engine cavity, where temperatures routinely exceed 100 Celsius, this thermal and mechanical weakness has resulted in unacceptable failure rates. Since the related art also recognizes the preferred use of unit 1 within the marina and water environments, where chemical reaction with the enhanced humidity and corrosive environment attacks adhesives, this material degradation has resulted in a similarly unacceptable failure rate.

As an additional detriment of the conventional construction discussed, while internal splash baffles (not shown) are discussed in '576 within air intake tube 11, it will be recognized that horn openings 4A and 4B are on the same level with air opening 12 for the compressor air intake, and are not similarly protected from the impact such rigid baffles would have on sound lone and overall sound quality. Therefore, while water penetration within the acoustic tubes via respective horn openings 4A and 4B is no less a danger then water penetration to air inlet tube 11, the related art has not recognized this detriment and has similarly not provided a solution. Consequently, while water-splashing and moisture may readily damage unit 1 via entry to horn openings 4A and 4B even while the unit is within a contained environment, for example an automotive engine cavity, there is an unsatisfied need for substantive improvements in weather and water resistance recognized within the related art. Therefore, there is a need for a weather resistant solution that has minimal or no impact on the generated tonal or sound quality.

Additionally of concern are circumstances wherein the unit is employed as a full replacement for an originally-manufactured horn for a vehicle. Where full replacement use occurs, consumers have no other alternative for emergency use, and consequently the horn must operate at the highest levels of reliability and safety.

What is not appreciated by the prior art therefore, is the need for an improved system comprising a compressor unit and housing member that avoids at least one of the detriments noted earlier so as to provide improved unit operational reliability, as well as operability, minimize mechanical and thermal failures within a wide field of user environments.

Accordingly, there is a need for an improved electric horn system, and more specifically and improved electropneumatic horn system that responds to one of detriments noted above.

SUMMARY OF THE INVENTION

An object of the present invention is to provide an electric horn system that overcomes at least one of the detriments noted above.

Another object of the invention is to provide an electric horn system having an improved compressor unit and monolithic housing assembly for enhanced multi-tonal sound generation through improved air venting to take in air for compression while reducing pressure.

Another aspect of the present invention is to provide an electric horn system, wherein an electropneumatic horn is provided with an improved and reliable connection between its housing and a corresponding compressor unit.

Another aspect of the present invention is to provide an electropneumatic horn system having increased resistance to vibration, thermal challenge, and chemical or environmental/weather related extremes.

Another aspect of the present invention is to provide an improved electropneumatic horn system operable at increased weather, environmental, and temperature extremes.

Another aspect of the invention provides an electropneumatic horn assembly comprising a compressor unit for the supply of compressed air, the compressor unit having a compressor air inlet, a compressor air outlet, and a motor housing, a monolithic housing embodying an opening defining a space for reception of the compressor unit, a sound generator assembly mounted on the monolithic housing, a plurality of vents embedded in the monolithic housing for venting air to or from an outer face of the compressor unit, and means for removably affixing the compressor unit in the housing, wherein the means for affixing elastically engages and removably affixes the compressor unit with the housing and maintains operational stability of the housing. The means for affixing the compressor unit with the monolithic housing further comprises at least one of adhesives, screws, hinges, spring clips, magnets, hooks, and hook-and-loop fasteners. Also, the horn assembly optionally further comprises a spacing element positioned between the monolithic housing and the outer face of the compressor unit.

Yet another aspect of the present invention provides an electropneumatic acoustic horn assembly comprising a monolithic housing assembly having a compressor housing portion having a cylindraceous configured receiving opening, wherein the housing assembly includes an attachment member for interconnection to an external support structure, an electric compressor unit being of cylindraceous configuration and having a compressor member, an opposing end to the compressor member, and at least a compressor air inlet to receive air and a compressor air outlet to supply compressed air, a sound wave generator system substantially housed in the monolithic housing assembly, wherein the generator system generates sound upon receipt of compressed air from the compressor unit, and an attachment member for securing the horn assembly to an external supporting structure, wherein the compressor housing portion includes a plurality of vents embedded in the compressor housing portion for venting air from an outer face of the compressor unit to reduce air temperature across the outer face.

The horn assembly according to the invention optionally further comprises means for removably affixing the compressor unit in the housing portion, wherein the means for affixing elastically engages and removably affixes the compressor unit with the housing portion and maintains operational stability of the housing. The means for affixing the compressor unit with the monolithic housing further comprises at least one of adhesives, screws, hinges, spring clips, magnets, hooks, and hook-and-loop fasteners. Also, the horn assembly optionally further comprises a spacing element positioned between the monolithic housing and the outer face of the compressor unit. Also, the horn assembly preferably further comprises means for removably affixing the electric compressor unit in the monolithic housing assembly, the means for affixing further comprising spring engagement means for elastically engaging and removably fixing the electric compressor unit in the receiving opening, and a motor housing affixedly joined with the electric compressor unit. In addition, the means for affixing may further comprise alignment pins for aligning the inner housing.

Still another aspect of the invention provides an electropneumatic horn assembly comprising a compressor unit having at least a compressor air inlet for receiving air and a compressor air outlet for the supply of compressed air, a sound generator system including an acoustic chamber formed between an inner and outer acoustic members and a membrane member rigidly removably positioned within the chamber between the inner and the outer members, the acoustic chamber having an opening for introduction of compressed air, a housing assembly having a compressor housing portion embodying an opening defining a space for reception of the compressor unit, the housing assembly having a sound generator housing portion for housing the sound generator system, and an air channeling device for communicating between the compressor air outlet and the opening of the acoustic chamber.

The horn assembly according to the invention optionally further includes the compressor unit having a cylindrical external configuration, the housing portion reception space also being of cylindrical configuration for receiving the compressor unit. Also, the horn assembly further comprises means for removably affixing the compressor unit in the housing portion, wherein the means for affixing elastically engages and removably affixes the compressor unit with the housing portion and maintains operational stability of the housing. The horn assembly may also optionally comprise an attachment member for securing the horn assembly to an external supporting structure, wherein the attachment member is selected from brackets, screws, rivets, clamps, lugnuts, wingnuts, and bolts.

According to the present invention, the compressor unit may also embody an air compressor pump at a top end thereof, the compressor unit having a bottom end opening, and means for sealing the bottom end to minimize an entry of debris and water into the housing assembly through the air compressor bottom end. Also, optionally, the sound generator system may further comprise an acoustic chamber formed between an inner housing member and an outer housing member, the chamber having an opening for the introduction of pressurized air, a membrane member removably positioned between the inner housing member and the outer housing member, and air channeling means for communicating between the opening of the acoustic chamber and an air outlet of an electric compressor unit for the horn assembly. Additionally, the membrane member may be provided with an opening for sound generation and at least one acoustic duct housed in a housing assembly and communicating between the acoustic chamber and at least one horn outlet to propagate sound generated by the membrane member outside the horn. The membrane member may also be positioned with lateral seal between the inner housing member and the outer housing member.

The present invention relates to an electric horn system including a monolithic rigid housing member having a receiving opening for fixably housing, in an non-removable and secure manner following assembly, a compressor member, thereby preventing unintended separation and improving reliability of the electric horn system. An acoustic sound wave generator includes an acoustic duct chambering system associated throughout with the monolithic rigid housing member. The acoustic sound wave generator receives compressed air from the compressor member to produce sound and propagate the same externally. A horn mounting system enables ready attachment of the system to a consumer-desired surface, the attachment being mechanical, magnetic, adhesive, or via any other known attachment or mounting system. Optional weather and water resistant systems prohibit unintended water access to the electric horn system enabling use of the system in exposed weather conditions for improved user convenience.

The present invention also relates to an electric horn system that allows permanent and irremovable attachment between the monolithic rigid housing member and the compressor member via a series of one-way attachment features preventing unintended separation. The invention also relates to an electric horn system that completely surrounds the compressor member offering protection of 360 degrees about an outer periphery of the compressor member.

According to an embodiment of the present invention, there is provided an electropneumatic acoustic horn assembly, comprising an electric compressor unit having at least compressor air inlet and a compressor air outlet for the supply of compressed air, and a sound rave generator system substantially housed in a monolithic housing assembly. The sound wave generator system further comprises at least one acoustic chamber having an opening for the introduction of the pressurized air, a membrane member provided with an opening for sound generation, and at least one acoustic duct housed in the monolithic housing assembly and communicating between the at least one acoustic chamber and at least one horn outlet to propagate the sound generated by the membrane member outside the horn. The sound wave generator system additionally comprises air channeling means for communicating between the compressor air outlet of the electric compressor unit and the opening of the at least one acoustic clamber, and means for permanently fixing the electric compressor unit in the monolithic housing assembly of the sound wave generator system, whereby the means for irremovably fixing prevents removal of the electric compressor unit and improves operational reliability of the assembly.

According to another embodiment of the invention, there is provided an electropneumatic acoustic horn assembly, wherein the monolithic housing assembly includes a monolithic compressor housing portion having a cylindraceous receiving opening. The electric compressor unit is cylindraceous and has a first and an opposing second end, the first end of the electric compressor unit being a compressor member. Additionally, the electric compressor unit has an electrical brush housing portion at the second opposing end, a motor housing joining the electric compressor unit, and the electrical brush housing portion. The means for permanently fixing the electric compressor unit in the monolithic housing assembly comprises spring engagement means for elastically engaging and permanently fixing the cylindraceous electric compressor unit in the cylindraceous receiving opening, thereby improving the reliability of the assembly.

According to another embodiment of the present invention there is provided an electropneumatic acoustic horn assembly, wherein the cylindraceous receiving opening includes opening side walls, the cylindraceous compressor unit having compressor side walls, the opening side walls and the compressor side walls being juxtaposed with each other upon an assembly of the electropneumatic acoustic horn assembly, and the spring engagement means including at least one spring locking tab member and at least one corresponding locking tab receiving groove, whereby during the assembly of the electropneumatic acoustic horn assembly the at least one spring locking tab urgingly engages the corresponding locking tab receiving groove and prevents removal of the compressor unit from the receiving opening.

Another embodiment of the invention provides an electropneumatic acoustic horn assembly, wherein the spring engagement means includes a plurality of the spring locking tab members and a corresponding plurality of the corresponding locking tab receiving grooves, and respective ones of the plurality of tab members and the receiving grooves arrayed about respective ones of the receiving opening and the compressor side walls.

Still another embodiment of the present invention provides an electropneumatic acoustic horn assembly, further comprising: means for aligning the cylindraceous compressor unit and the compressor air outlet with the opening in the acoustic chamber for the introduction of the pressurized air. The aligning means includes at least one alignment member and at least one alignment groove having complementary shapes for interfitting during the assembly, whereby the alignment member and the groove are slidingly arranged to align the compressor air outlet with the opening.

Another embodiment of the present invention provides an electropneumatic acoustic horn assembly, wherein the at least one horn outlet includes means for minimizing at least one of a debris and a water entry during a use of the assembly. The means for minimizing includes at least one selected from a group comprising an opening seal sealing the at least one horn outlet; at least one flexible louver member flexibly covering the at least one horn outlet, at least one flexible shield member pivotably covering the at least one horn outlet, and at least one of a woven and a metal mesh. The at least one minimizing means enables a release of sound from the at least one horn outlet while minimizing entry of debris and water into the monolithic housing assembly.

Yet another embodiment of the invention provides an electropneumatic acoustic horn assembly, further comprising: at least one housing air inlet passage in the monolithic housing assembly, at least one compressor air inlet passage in the monolithic housing assembly communicating from the at least one housing air inlet passage to the compressor air inlet, and at least one air inlet including at least one means for minimizing at least one of a debris and a water entry during a use of the assembly. The means for minimizing includes at least one selected from a group comprising: an opening seal sealing the at least air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

Another embodiment of the present invention provides an electropneumatic acoustic horn assembly, further comprising at least one housing air inlet passage in the monolithic housing assembly, and at least one compressor air inlet passage in the monolithic compressor housing portion communicating from the at least one housing air inlet passage to the compressor air inlet. The means for minimizing includes at least one selected from a group comprising an opening seal sealing the at least one air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

Yet another embodiment of the invention provides an electropneumatic acoustic horn assembly, wherein the at least one housing air inlet passage in the monolithic housing assembly is proximate the electrical brush housing portion at the second opposing end, and the at least one compressor air inlet passage extends from the air inlet passage through the monolithic housing assembly to the compressor air inlet at the first end of the electric compressor unit.

Another embodiment of the present invention provides an electropneumatic acoustic horn assembly further comprising means for securing the monolithic housing assembly to an external support member. The means for securing including at least one selected from the group comprising a protruding mounting bracket member, a magnetic mounting member, a suction-based mounting member, an adhesive mounting member, and a strap mounting member, whereby the means for securing enables ready attachment of the assembly to the external support member.

According to still another embodiment of the invention, provided is an electropneumatic acoustic horn assembly, comprising a cylindraceous electric compressor unit having at least a compressor air inlet and a compressor air outlet for the supply of compressed air, a first and opposing second end, and a sound wave generator system substantially housed in a monolithic housing assembly. The monolithic housing assembly has a monolithic compressor housing portion having a cylindraceous receiving opening, and the sound wave generator system further comprises at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly.

According to yet another embodiment of the invention, provided is an electropneumatic acoustic horn assembly, wherein the first end of the electric compressor unit being a compressor member, and a motor housing fixably joining the electric compressor unit. The means for permanently fixing further comprises spring engagement means for elastically engaging and permanently fixing the cylindraceous electric compressor unit in the cylindraceous receiving opening, thereby improving the reliability of the assembly.

Another embodiment of the present invention provides an electropneumatic acoustic horn assembly, further comprising an electrical brush housing portion, means for securing the electrical brush housing portion at the second opposing end of the electric compressor unit, and the means for securing the electrical brush housing portion being one of a removable means for securing and a permanent means for securing.

According to another embodiment of the invention, provided is an electropneumatic acoustic horn assembly, further comprising means for sealing the electrical brush housing portion to a sealing surface of the monolithic compressor housing portion, and whereby the means for sealing minimizes one of a debris and a water entry to the electric compressor unit and improves operational reliability of the assembly.

Still another embodiment of the present invention provides an electropneumatic acoustic horn assembly, wherein the springing engagement means includes a plurality of the springing locking tab members and a corresponding plurality of the corresponding locking tab receiving grooves, and respective ones of the plurality of tab members and the receiving grooves are arrayed about respective ones of the receiving opening and the compressor side walls.

According to another embodiment of the present invention, provided is an electropneumatic acoustic horn assembly, further comprising means for aligning the cylindraceous compressor unit and the compressor air outlet with the opening inlet in the acoustic chamber for the introduction of the pressurized air. The aligning means including at least one alignment member and at least one alignment groove having complementary shapes for interfitting during the assembly, whereby the alignment member and the groove are slidingly arranged to align the compressor air outlet with the opening.

According to yet another embodiment of the present invention, provided is an electropneumatic acoustic horn assembly, wherein the means for permanently fixing the electric compressor unit in the monolithic housing assembly of the sound wave generator system further comprises at least one of a group comprising spring engagement means for elastically engaging and permanently fixing the cylindraceous electric compressor unit in the cylindraceous receiving opening, thermal welding means for thermally welding portions of the cylindraceous electric compressor unit with the monolithic compressor housing portion, and adhesive fixing means for adhesively bonding portions of the cylindraceous electric compressor unit with the monolithic compressor housing portion, whereby the means for permanently fixing improves operational reliability of the assembly.

Another embodiment of the present invention provides an electropneumatic acoustic horn assembly, wherein the at least one horn outlet includes means for minimizing at least one of a debris and a water entry into the horn outlet during a use of the assembly. The means for minimizing includes at least one selected from a group comprising an opening seal sealing the at least one horn outlet, at least one flexible louver member flexibly covering the at least one horn outlet, at least one flexible shield member pivotably covering the at least one horn outlet, and at least one of a woven and a metal mesh, whereby the at least one minimizing means enables a release of sound from the at least one horn outlet while minimizing entry of debris and water into the monolithic housing assembly.

Still another embodiment of the invention provides an electropneumatic acoustic horn assembly, further comprising at least one housing air inlet passage in the monolithic housing assembly, at least one compressor air inlet passage in the monolithic compressor housing portion communicating from the at least one housing air inlet passage to the compressor air inlet, and at least one air inlet including at least one means for minimizing at least one of a debris and a water entry during a use of the assembly. The means for minimizing includes at least one selected from a group comprising an opening seal sealing the at least one air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

Yet another embodiment of the present invention provides an electropneumatic acoustic horn assembly, further comprising means for securing the monolithic housing assembly to an external support member. The means for securing including at least one selected from the group comprising a protruding mounting bracket member, a magnetic mounting member, a suction-based mounting member, an adhesive mounting member, and a strap mounting member, whereby the means for securing enables ready attachment of the assembly to the external support member.

According to another embodiment of the invention, provided is an electropneumatic horn assembly, further comprising an electric compressor unit having a compressor air inlet and a compressor air outlet for the supply of compressed air. Additionally, the assembly comprises a monolithic housing assembly having a first housing portion embodying an opening defining a space for reception of said compressor unit in said first housing portion, and a second housing portion substantially housing a sound wave generator system. Further, the assembly comprises a set of one or more vents, embedded in said monolithic housing assembly, the set of one or more vents for venting air from said sound wave generator system for the purpose of reducing air pressure within said sound wave generator system.

In still another embodiment, the horn assembly comprises at least one acoustic chamber having an opening for introduction of compressed air, a membrane member provided with an opening for sound generation and at least one acoustic duct housed in the housing assembly and communicating between the at least one acoustic chamber and the at least one horn outlet to propagate sound generated by the membrane member outside the horn. There are also air channeling means for communicating between the compressor air outlet of the compressor unit and the opening of the at least one acoustic chamber. Additionally, the horn assembly may comprise means for permanently affixing the electric compressor unit in the housing assembly whereby the affixing means prevent removal of the electric compressor unit and improves operational stability of the housing assembly.

Yet another embodiment of the present invention provides an electropneumatic acoustic horn assembly, comprising a sound wave generator system substantially housed in a monolithic housing assembly and having a monolithic compressor housing portion having a cylindraceous configured receiving opening, and an electric compressor unit being of cylindraceous configuration. The compressor unit has at least a compressor air inlet and a compressor air outlet for the supply of compressed air, a set of one or more vents for venting air from said sound wave generator system for the purpose of reducing air pressure within said sound wave generator system, a compressor member, and an opposing end to said compressor member. Additionally, the horn comprises means for securing the monolithic housing assembly to an external supporting structure.

The means for securing the monolithic housing assembly to an external supporting structure further comprises at least one selected from a protruding mounting bracket member, a magnetic mounting member, a suction-based mounting member, an adhesive mounting member, and a strap mounting member, whereby said means for securing enables ready attachment of said assembly to said external supporting structure. An embodiment of the bracket member further comprises a top-in receiving member for receiving a securing member such as a screw, a bolt or a pin which can be locked in place by a nut, a cotter pin, or a cap; and, having a recessed surface bounded by an edge for allowing the top end of the securing member to be flush with or lower than the edge. Another embodiment of the bracket member comprises a side-in receiving member for receiving the securing member.

Also, according to the invention provided is an electropneumatic acoustic horn assembly, comprising an electric compressor unit having at least a compressor air inlet and a compressor air outlet for the supply of compressed air, a sound wave generator system comprising at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly. Importantly, the acoustic chamber is preferably comprised of a substantially round and rigid membrane member removably affixed with lateral seal between an outer housing member and an inner housing member attached to the horn assembly. That is, the membrane member is affixed within the diaphragm without the need to deform the membrane, and thus minimizes or even prevents the potential for deformities caused by unwanted particles entering the sound chamber. In the preferred embodiment of the diaphragm according to the invention, outer housing, membrane member, and inner housing are all of the same shape and size and are attached via removable attachment means such as screws. Other known attachment means may also be used.

According to another embodiment of the present invention the diaphragm includes means for minimizing at least one of a debris and a water entry during a use of the assembly, and the means for minimizing includes at least one selected from a group comprising an opening seal, at least one flexible louver member, at least one flexible shield member, and at least one of a woven and a metal mesh, whereby the at least one minimizing means enables a release of sound from the horn while minimizing entry of debris and water into the monolithic housing assembly.

According to yet another embodiment of the present invention provided is an electropneumatic acoustic horn assembly, comprising a cylindrical electric compressor unit having at least a compressor air inlet and a compressor air outlet for the supply of compressed air, a first and opposing second end, and a sound wave generator system substantially housed in a monolithic housing assembly. The monolithic housing assembly has a monolithic compressor housing portion having a cylindrical receiving opening. The sound wave generator system comprises at least one acoustic chamber having an opening for the introduction of the pressurized air, a membrane member provided with an opening for sound generation, and at least one acoustic duct housed in the monolithic housing assembly and communicating between the at least one acoustic chamber and at least one horn outlet to propagate the sound generated by the membrane member outside the horn. Also provided is an air channeling means for communicating between the compressor air outlet of the electric compressor unit and the opening of the at least one acoustic chamber, and a means for permanently fixing the electric compressor unit in the monolithic housing assembly of the sound wave generator system, where the means for irremovably fixing prevents removal of the electric compressor unit and improves operational reliability of the assembly.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 1 is a front perspective view of a conventional prior art electropneumatic horn assembly;

FIG. 1A is a partial cross-sectional view along section line 1A-1A in FIG. 1;

FIG. 11 is a front perspective view of yet another alternative embodiment of an electropneumatic horn system according to the invention showing the air venting channels;

FIG. 12 is a bottom up view of the compressor chamber and pump housing with mounting bracket of the electropneumatic horn system shown in FIG. 11;

FIG. 13 is a front on view of the compressor chamber with its integrated venting channels of the electropneumatic horn system of FIG. 11;

FIG. 14 is a fragmentary sectional view of the bracket mounting assembly for use with the electropneumatic horn system according to the invention;

FIG. 15 is a fragmentary sectional view of an alternative embodiment of the bracket mounting assembly for use with the electropneumatic horn system according to the invention;

FIG. 16 is a perspective view of an electropneumatic horn system showing the air venting channels in accordance with an alternative embodiment of the invention;

FIG. 20 is a fragmentary sectional view taken along line 20-20 in FIG. 16 of an embodiment of the engagement spring clip between the first bonding surfaces of the housing portions of the electropneumatic horn system according to the invention; and FIG. 21 is a fragmentary sectional view taken along line 21-21 in FIG. 16 of an embodiment of the spacer and air channel between the compressor face and the first housing portion of the electropneumatic horn system according to the invention.

DETAILED DESCRIPTION OF THE PREFERRED EMBODIMENTS

Figure 2:
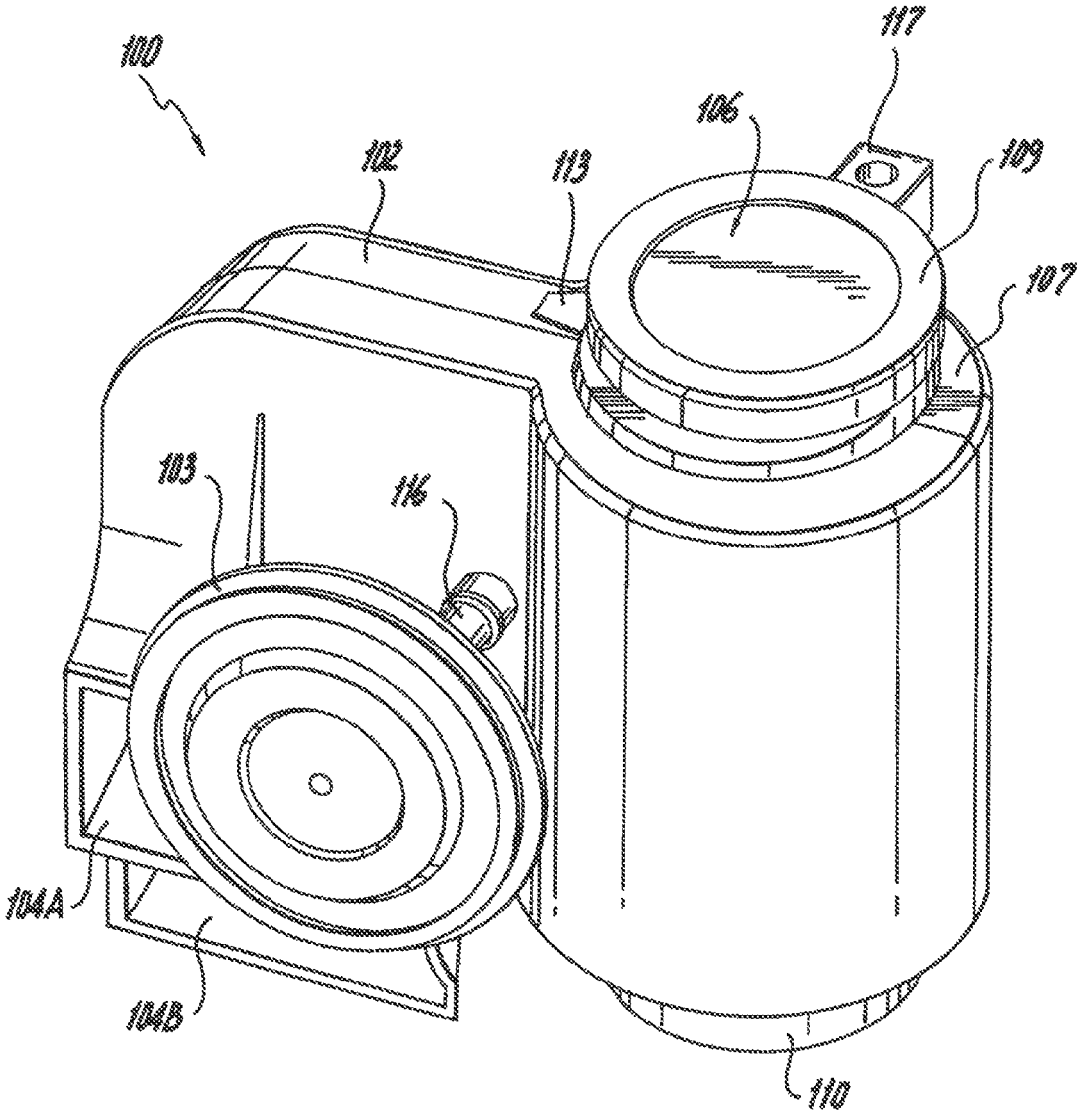
FIG. 2 is a front perspective view of a first embodiment of an electric horn system according to the present invention.
Figure 2A:
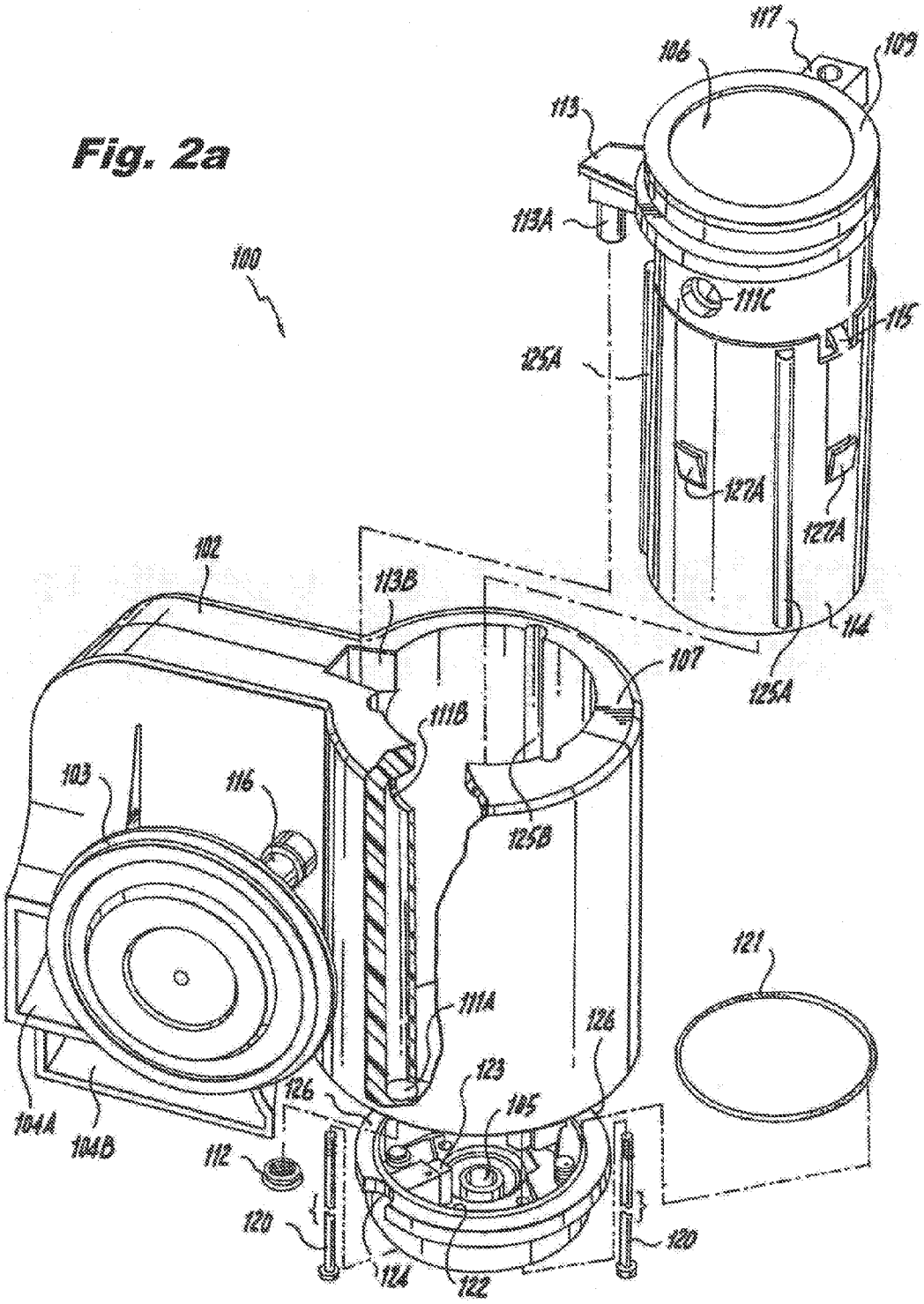
FIG. 2A is an exploded view of the embodiment in FIG. 2.

As required, a detailed illustrative embodiment of the present invention is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the invention in any manner.

Referring first to FIGS. 2, 2A, 3, and 4, an alternative embodiment of an electropneumatic horn has been provided that overcomes at least one of the detriments in the related art noted above. As shown, electropneumatic horn unit 100 includes a rigid housing unit member 102 having a monolithic compressor housing region 107, and an internally formed dual tonal acoustic ducting system (not shown). The dual tonal acoustic ducting system is similar to that shown in U.S. Pat. No. 7,038,576, and the entire contents of '576 are herein again enclosed again by reference. The dual tone acoustic ducting system receives compressed air exiting a compressed air outlet 113A of an air outlet fixture 113 from a compressor unit 106 (as will be discussed), passes the same via diaphragm members 103, 103 (only one shown) through a diaphragm air supply portal 116 so as to activate the same as sound generators. The sound so generated passes through the dual tone ducting system to exist via respective horn openings 104A, 104B. As will be additionally discussed the tone or sound generation functions of the proposed embodiment are related to those noted in the incorporated '576 patent.

As will be noted from study of the renderings, compressor unit 106 having a bottom positioned brush housing member 110 and an opposing top sided compressor member 109 is completely surrounded by the monolithic body structure of housing unit 102 in the manner depicted. As will be discussed, a rear suspending bracket 117 is rearwardly projected from compressor member 109 in a manner familiar to those of skill in the art, although substantial improvements of this construction are noted in FIGS. 3, 4, and 5, as will be later discussed to secure horn unit 100 to a desired position.

Compressor unit 106 includes an air intake opening 111C proximate compressor member 109 (FIG. 2A), and when compressor unit 106 is operating dispenses compressed air via air outlet fixture 113, as shown. Upon assembly, air outlet fixture 113 nests securely within air outlet receiving block 113B in housing 102 which includes an air intake receiving opening (not shown) for receiving such generated compressed air for horn operation.

As will be noted a motor housing 114 spaces brush housing 110 from compressor member 109 and securely engages compressor pump member 109 via formed bent metal finger members 115 at periodic intervals about a periphery so as to ensure permanent attachment. The motor housing 114 has a metal shell to support metal finger members 115 but also includes optionally both (a) a plurality of orientation or alignment members 125A protruding at regular intervals about a periphery (three are used herein and two are shown), and (b)

permanent locking tab member 127A having a hinged end springingly extending from motor housing 114 and ending in a cantilevered spring finger portion (as shown) for engaging and permanently fixing motor housing 114 into housing unit 102, as will be discussed.

An air inlet channel or tube or passage 111 is internally positioned within a wall member of monolithic housing member 102, and extends from a bottom air inlet opening 111A to a top air exit opening 111B aligned and in communication with air inlet 111C after unit assembly. An air inlet screen member 112 is fixably positioned in air inlet 111A and being preferably of a fine mesh construction prohibits water entry by physical blockage and capillary forces while simultaneously enabling a full flow of air to enter compressor unit 106.

Brush housing 110 is formed as a fixable cap member and includes a central self-lubricating bearing or bushing member 105 allowing passage of electrical power to respective brushes 123, 123 (only one shown). While brush housing 110 is formed for receipt of wires, it will be recognized by those of skill in the art that alternative constructions to allow electrical connection to respective brushes 123 may be achieved without departing from the scope of the present invention. For example, an electrical connection to respective brushes 123 and 123 may be achieved employing solid state copper electrical fingers (not shown) projecting from a bottom portion of brush housing 110 and engaging respective electric finger members (not shown) crimped on the end of respective electrical wires (not shown), all without departing from the scope and spirit of the present invention.

As depicted, brush housing 110 has a peripheral extending lip member 122, having a thickness 126 and projecting outwardly sufficiently to engage the bottom surface of monolithic housing member 107 and to form a weather tight seal thereto. As an additional safety factor, extending lip member 122 may optionally include a sealing O-ring channel (not shown) and a flexible elastomeric O-ring 121 to prohibit water entry. An optional cut lip region 124 is shown such as to prohibit lip member 122 from blocking air access to air opening 111A. It will be recognized, that alternative constructions may be envisioned without departing from the scope and spirit of the present invention, including those without a lip region 124 and with alternative sealing mechanisms, such as the use of liquid sealants and mechanical friction seals.

A pair of locking screws 120 and 120 pass through brush housing member 110 to engage openings in motor housing 114 and engage and lock with threaded holes on an underside surface (not shown) internal to compressor pump member 109, thereby fixedly securing brush housing member 110 into compressor unit 106, sealing brush housing 110 to the bottom surface of monolithic compressor housing portion 107, and drawing and urging compressor unit 106 fully into housing 102 to fully engage locking tabs 127A in respective locking engagement openings 128B (see FIG. 3) formed in the rigid wall of monolithic housing member 107, as will be discussed.

A particular advantage of the proposed construction is that locking tabs 127A and corresponding locking grooves 128A provide an initial stage of permanently fixing compressor member 106 in housing unit 102. As an important secondary advantage it must be recognized that the present construction involving sealing brush housing 110 and locking screws 120 provides a second mechanism or system for securing and permanently fixing compressor unit 106 in position by actually urging a secure positioning and compressing or drawing-tightly of the compressor member 109 to the top side of housing unit 120 while simultaneously drawing brush pump housing 110 upwardly to the bottom side of housing unit 120 and sealing lip member 122 to the bottom surface thereby also ensuring complete installation of locking tabs/grooves 127/128 while improving weather resistance and preventing moisture entry. As a consequence, it will be recognized that the proposed invention adds multiple forms of permanently fixing that operate in distinctly different but complementary manners to achieve the desires of the proposed invention and provide a distinct advantage during manufacturing.

During assembly of the present preferred embodiment, it is envisioned that housing unit 102, with monolithic housing member 107 is secured in position and a operator or machine grips a pre-assembled motor housing 114 and compressor 109 (fixed together by fixing fingers 115). The operator then orients compressor 109 so that air outlet fixture 113 is oriented to be fittingly received within air outlet receiving block 113B and initially engages the bottom of motor housing 114 in the opening in monolithic housing member 107. While not required for the invention, and as an additional benefit, the motor housing 114 shown includes a plurality of alignment members 125A that mesh with a plurality of pre-formed alignment slots 125B formed on an inner wall of the compressor opening to aid and secure alignment.

As will be appreciated from the figures, while only a single pair of alignment member 125A and alignment slot 125B may be employed, the present embodiment includes a plurality of the same arrayed about the opening in monolithic housing 107 for improved security and eased assembly. In this way, the present invention enable swift and secure alignment during an assembly and minimizes a risk of unintended damage by contacting air outlet fixture 113 with the top surface of monolithic housing 107. It is note that such unintended contact is a common assembly problem with the related art represented by U.S. Pat. No. 7,038,576, and results in quality control losses during assembly.

As will be additionally appreciated from the figures, receiving openings 128A are formed within the inner side wall of the receiving opening of monolithic housing member 107 at pre-determined intervals to receive respective spring engaging and fixing member fingers 127A. With the above-noted aid to alignment, locating specific pairs of fingers 127A/openings 128A is eased and simplified because there is no need, and indeed no ability, to rotate motor housing 114 relative to monolithic housing 107 after initial alignment. It is respectfully noted, that the receiving opening in monolithic housing 107 is shaped to snuggly fit the outer perimeter surface of the assembled motor housing 114 and compressor pump member 109 so as to allow secure engagement with fingers/holes 127A/127A as a permanent fixing mechanism preventing the removal of motor housing 114 (and the compressor unit 106) following initial assembly. It is additionally noted, in FIG. 4, that an alternative fixing mechanism may be employed, wherein, projecting spring engaging fingers 127B project from the inner side wall of the monolithic housing 107 and are lockingly received in respective engaging openings 128B formed in the outer periphery of motor housing 114 as shown. In this way, the present invention envisions a plurality of single use locking mechanisms that enable an initial assembly between monolithic housing 107 and compressor unit 106 and that prevent the possibility of removal thereafter, thereby removing the risk of unintended separation.

As will be additionally noted from the Figures, an outer projecting rim of compressor member 109, shown on a proximate level with air outlet fixture 113 is firmly fixed to the top surface of monolithic housing member 107. As a consequence, the present embodiment it is noted, that during an assembly, the sub-combination of motor housing 114 and compressor member 109 are pre-assembled and then aligned, inserted, and fixably and non-removably locked in position within monolithic housing such that the outer projecting of compressor member 109 seals the same to the top surface of monolithic housing member 107. It is noted that any form of additional seal may be employed, such as an O-ring or sealing caulk, to improve the seal between the outer projecting rim and the monolithic housing member 107. It is envisioned that where such an O-ring is employed for sealing, a complementary O-ring groove or opening may be additionally employed to secure the O-ring in position. Such an O-ring groove may be on the brush housing lip 122, on the top or bottom of monolithic housing member 107, and on the projecting rim of compressor member 109, without departing from the scope and spirit of the present invention.

Following installation of the sub-combination, the sealing member (O-ring shown) is positioned on the outer locking flange of the brush housing member 110 and locking screws 120 are inserted and tightened, fully sealing brush housing member 110 to compressor unit 106 and serving to apply a sealing tension on opposing sides of monolithic housing member 107 to improve unit reliability and manufacturing quality by preventing vibratory separation, temperature change damage, and the other detriments causing concern in the related art.

While the present embodiments contemplate the use of opposing spring fingers and receiving openings for allowing a form of single-use locking engagement during insertion, nothing herein shall so limit the invention. Those of skill in the art will appreciate that alternative locking mechanisms, assemblies, or elements may be employed without departing from the spirit and scope of the present invention. For example, permanently fixing compressor unit 106 in monolithic housing member 107 may be achieved additionally by the use of (a) locking high-durability adhesives, (b) thermal welding of plastic portions, (c) threaded-use-failure members (that thread in to a threaded path and lock in-place), (d) the use of pivot-locking members much as swing or pivot arms within either monolithic housing member 107/motor housing 114 which engage after insertion to fixably position compressor unit 106, and (e) other cam or key-way type engagements where a cam or key member are inserted between the monolithic housing unit 107 wall and motor housing 114, since all such adaptive fixing mechanisms are known to those of skill in related arts and may be adapted as required to fulfill this goal.

Figure 3:
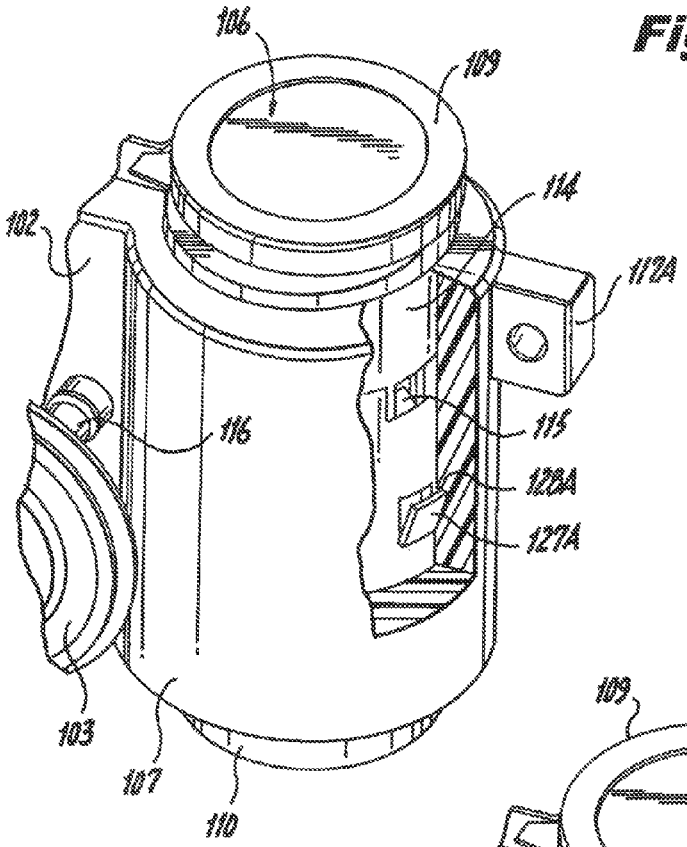
FIG. 3 is a partial sectional perspective view of a wall section assembly of the embodiment in FIG. 2.
Figure 4:
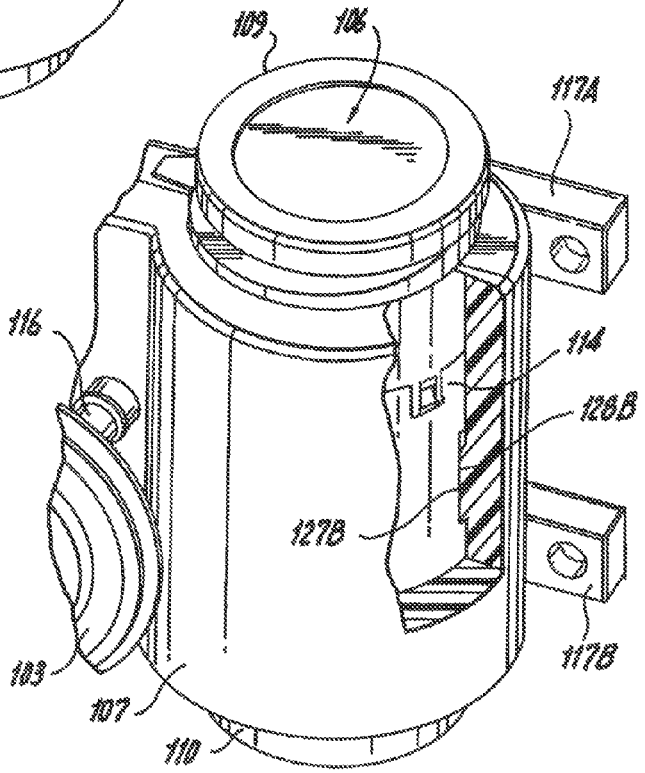
FIG. 4 is a partial sectional view of an alternative engagement feature between a compressor unit and the monolithic housing.

Referring specifically now to FIGS. 3 and 4, alternative forms of the mounting bracket are shown, this time extending from monolithic housing member 107 as mounting members or blocks 117A (on a top side), and optionally as a pair with a block 117B at a bottom portion. As will be appreciated by those of skill in the art, the present invention repositions the housing blocks to the much stronger housing unit member 102 generally, and extends multiple mounting points to prohibit breakage due to the excessive vibration from compressor unit 106.

While the present embodiment provides such mounting members or blocks 117A, 117B, it is additionally envisioned that alternative mounting systems may be employed without departing from the scope and spirit of the present invention. To this end, the present invention contemplates the use of magnetic, adhesive, and buckle and strap-type mounting systems. Regarding magnetic mounting system, it is envisioned that monolithic housing unit 102 may be readily molded and formed to receive a flush-mounted inset magnet or a series of flush-mounted or other magnetic members on a rear-attachment surface thereof. Employing such a magnetic mounting system it is envisioned that unit 100 may be readily positioned and secured in place on a magnetic or paramagnetic surface, such as a mounting wall within an automotive engine compartment. Regarding an adhesive mounting system, it is envisioned that, similarly to the magnetic mounting system, the molded monolithic block 102 be formed with planar faces on a rear or side surface thereof such that a high temperature or thermal welding adhesive may readily permanently fix unit 102 to any selected mounting surface. In combination with any of the above mounting systems, or alone, a buckle and strap-type mounting system is envisioned wherein rigid strap ridges and built in strap mounting arms are formed permanently in the monolithic housing member 102, thereby allowing unit 100 to be strapped and fixed to a bar, beam, flat surface, or other structure element so as to prevent unintended removal.

As an additional benefit of the present invention, it is envisioned that horn openings 104A, 104B may be additionally made weather resistant by the use of Gortex™ type flexible shutters sealing each opening from moisture and dirt incursion so as to prevent the horn's premature failure in a wet or dirty operating environments while at the same time allowing the horn to produce the regular powerful tonal sound (limited if any decrease in sound performance). Such a shutter may be viewed as a single sealing piece of flexible material sealed over the opening but allowing vibration passage, a series of draping folds of similar material that drape closed under the force of gravity when not in use and spread open to allow sound release during a use, or a single draping fold on a hinged arm allowing only one-way sound exit while preventing inward entry of water and debris to the horn's sound chambers. Those of skill in the art will also recognize that such a similar piece of sealing substantially waterproof or water resistant material may be provided for air intake opening 111A or 111C to prevent related damage to compressor unit 106. In all, those of skill in the art of product design will recognize that the use of such systems will virtually render the entire horn as waterproof, and certainly water proof for periodic splashes or immersion due to splashing when installed in an automobile, on a motorcycle, on a boat, or other vehicle.

Figure 5:
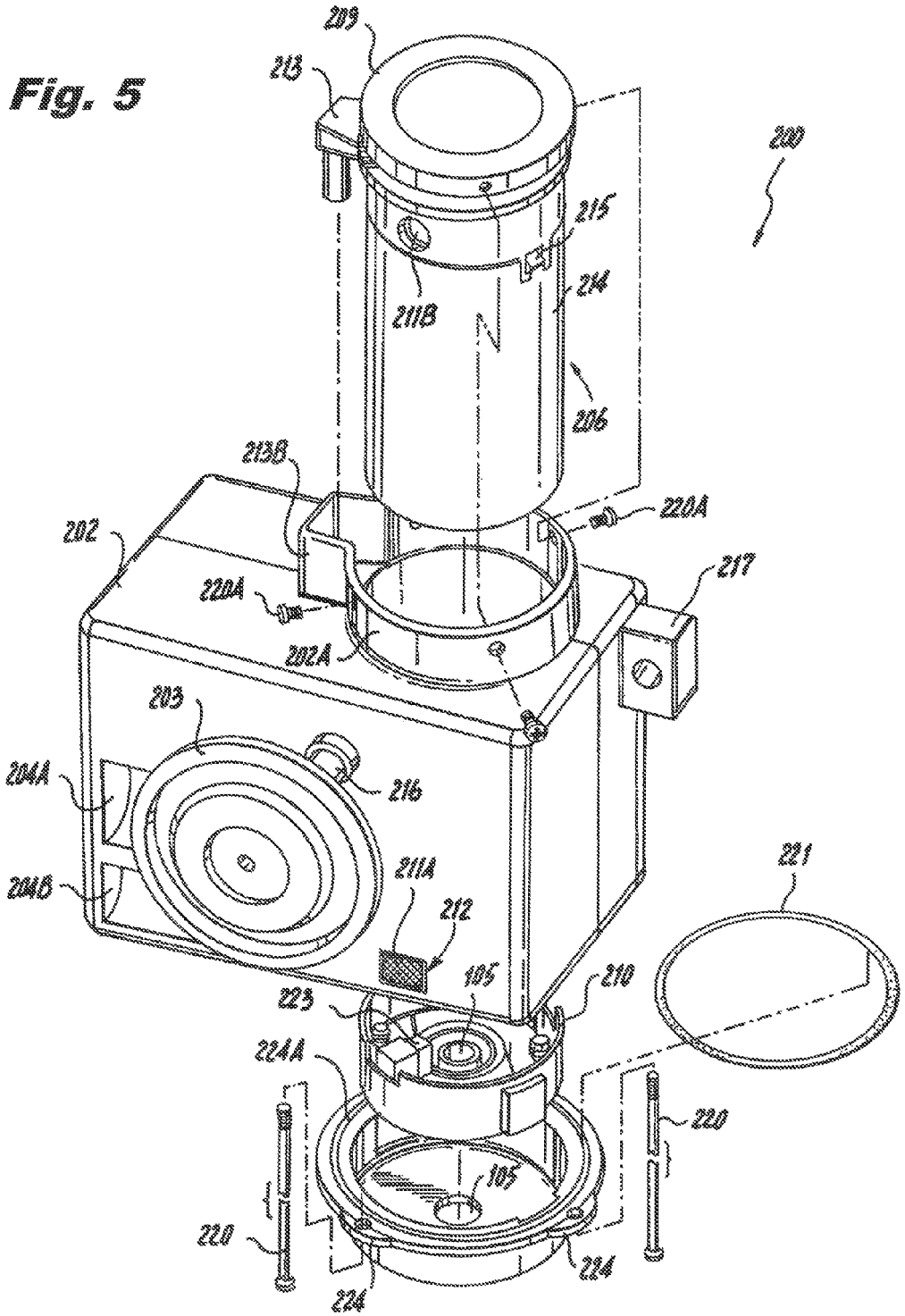
FIG. 5 is an exploded perspective view of a second alternative embodiment of an electric horn system according to the present invention.

Referring now to FIG. 5, shown is an alternative embodiment of a monolithic electropneumatic sound generator unit 200 comprising a monolithic housing block member 202 for receiving a partially assembled compressor unit 206, as shown. As noted from examining the figure, the entire acoustic tonal generator is, as was noted above, internal to monolithic housing block member 202 and operates via received compressed air from compressed air outlet fixture 213 (when inserted into protective air outlet receiving block 213B) through respective internal tonal chambers passed diaphragm air supply ports 216, 216 (only one shown) and respective diaphragm units 203, 203 (only one shown) to generate sound which then is conducted via the remainder portions of respective internal tonal chambers to respective horn openings 204A, 204B for exit to the atmosphere. It is noted that constructions for the internal acoustic tonal passageway internal to the monolithic block are well known to the art and are generically represented by U.S. Pat. No. 7,038,576, the entire contents of which are again herein incorporated by reference, and it is only the external appearance of monolithic housing member 202 which is improved according to the present invention.

As noted earlier, compressor unit 206 includes a metallic motor housing portion 214 that is fixed to compressor member 209 as a first installation member or assembly, and is later assembled with a bottom brush housing member 210, as will be discussed for permanently mounting into monolithic housing block member 202. Also, a protective fixing skirt 202A extends upwardly from the top surface of monolithic housing block member 202 and is shaped to fixably receive the first installation member as shown. A plurality of outer locking openings (shown but not numbered) in fixing skirt 202A receive respective fixing bolts 220A which engage and fixably seal with threaded openings in the top extending flange from compressor member 209 (as shown). In this manner, during assembly the first installation member or assembly is oriented to align air intake opening 211B with an internal air channel outlet (not shown which extends from an external air intake opening 211A protected by a protective screening member 212), and to align air outlet fixture 213 with air outlet receiving block portion 213B. The installation member or assembly is then inserted into monolithic housing member 202 (as shown).

At this point either fixing members, the fixing bolts 220A are inserted and fixed into the outer flange of compressor member 209 to fix the member in place, and/or additional locking members are employed (such as the locking tabs/openings noted in the earlier embodiment), to permanently fix the first installation member of compressor 206 in position. It shall be recognized, that while the present embodiment discloses only one fixing option (fixing bolts 220A), that alternative and different fixing mechanisms may be used to permanently retain the first installation member or assembly (compressor member 209 and motor housing 214), and prevent it's removal following such assembly without departing from the spirit and scope of the present invention.

Thereafter, brush housing member 210, having respective brushes 223 and bearing member 105 is positioned in a bottom of the receiving opening in monolithic housing member 202, and permanent locking tabs 230 are lockingly inserted in respective receiving slots in the bottom side of housing member 202. Thereafter, a bottom sealing cap member 225 having a respective outer flange and periphery mounting portions 224 is positioned, sealing O-ring member 221 is also positioned in O-ring groove 224A, and respective locking bolt members 220 are inserted and locked in place fixing bottom sealing cap member 225 in position. As noted in the figure a bearing pocket 105' or bearing seal 105' enables the rotational end of the axle of motor housing 214 to extend through (if optionally needed) bearing 105 and still be covered by cap member 225 for a weather resistant seal (for example pocket or seal 105' may be formed as a concave receiver retaining the pivoting end of the motor axle. As a consequence of this construction it will be recognized that the present proposed assembly 220 is formed to receive and permanently fix compressor unit 206 in position following such assembly, and to prevent removal by a variety of mechanisms.

It will be recognized, that sealing O-ring member 221 and O-ring groove 224A represent only one of a plurality of ways of sealing and protecting brush housing member 210 from weather encroachment. It will also be appreciated, that alternative constructions may seal bearing 105 in respective housing 210, and also that cap member 225 may be replace with an alternative construction that allows a sealed electrical connection to the brushes without departing from the scope and spirit of the present invention. Such sealed electrical connections are known to those of skill in the consumer electronic arts, and may optionally include extending contact blades of copper that receive external electrical connection through cap 225. Consequently, while power supply openings 105 may be readily sealed in ways known to those of skill in the art, other sealing designs shall be considered to be within the scope of the present disclosure.

Additionally, it is envisioned that a top compressor member sealing system (not shown) may be employed to provide a weather resistant cover (not shown) to the top of compressor member 209 following installation. Such a weather resistant cover may be formed with an expanding top flange and O-ring assembly (not shown), an external rubber cap may be sealed about skirt member 202A, or a sealing and fixing epoxy may be poured within and over skirt member 202A to both seal and fix the first assembly member of compressor assembly 206 it place.

It will also be appreciated by those of skill in the art that the present assembly overcomes at least one of the detriments noted in the related art and provides a rigid and secure mounting between the acoustic generation portion of the electropneumatic horn assembly and the compressor portion, thereby improving reliability. To this aid, attachment flanges 217 extend from portions of monolithic housing block 202 (one is shown) to enable easy fixing in place. Such attachment flanges 217 may be readily positioned elsewhere on monolithic housing, or replaced with any of the other mounting constructions noted herein, without departing from the spirit and scope of the present invention.

As noted earlier, the present embodiment enables sealing of the compressor unit 206 assembly openings on the top and bottom portions of the monolithic housing assembly 202. As an additional benefit sealing screen 212 resists water and debris uptake while allowing air-passage. Similarly, the present embodiment of the electropneumatic horn assembly 200 may include the other optional sealing matters discussed above without departing from the scope and spirit of the present invention. For example, sealing Gortex shutters may provide one-way exit flow from horn openings 204A, 204B, sealing diaphragms may cover the openings, or other water and debris resistant covers may seal horn openings without departing from the scope and spirit of the present invention. In this manner, those of skill in the art will recognize that alternative and adaptive constructions may render the present embodiment substantially weather resistant and allow for adaptive installation in weather-exposure environments as an improvement of the related art.

Figures 6, 6A, 6B:
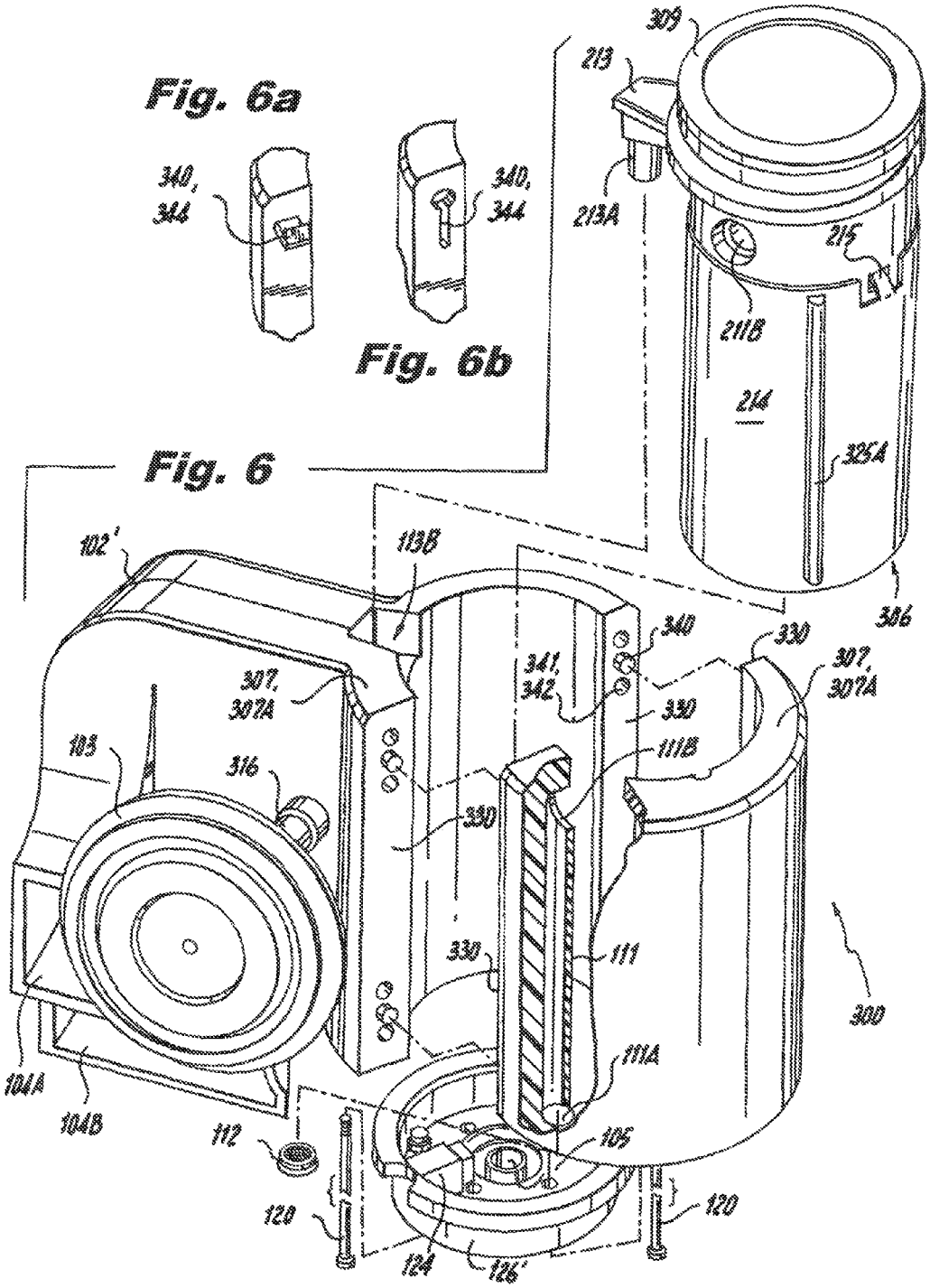
FIG. 6 is an exploded perspective view of a third alternative embodiment of an electric horn system according to the present invention.
FIGS. 6A, 6B are close up views of alternative alignment means between the bonding surfaces noted in FIG. 6.

Referring additionally now to FIGS. 6, 6A, and 6B a third electropneumatic horn unit 300 includes a divided rigid housing unit member 102' having a divided monolithic compressor housing region 307A, 307B, as shown, and an internally formed dual tonal acoustic ducting system (not shown). The dual tonal acoustic ducting system is similar to that shown in U.S. Pat. No. 7,038,576, and the entire contents of the '576 patent are herein again enclosed again by reference. The dual tone acoustic ducting system receives compressed air exiting a compressed air outlet 213A of an air outlet fixture 213 from a compressor unit 306 (as will be discussed), passes the same via diaphragm members 103, 103 (only one shown) through respective diaphragm air supply portals 316 so as to activate the same as sound generators. The generated sound passes through the dual tone ducting system to exist via respective horn openings 104A, 104B. As will be additionally discussed, the tone or sound generation functions of the proposed embodiment are related to those noted in the incorporated '576 patent.

As will be noted from study of the renderings, compressor unit 306 having a bottom positioned brush housing member 126' and an opposing top sided compressor member 309 is completely surrounded by the monolithic body structure of housing unit 102' in the manner depicted. As was discussed in the earlier embodiments, a rear suspending bracket (not shown) is rearwardly projected from compressor member 309 in a manner familiar to those of skill in the art, although substantial improvements of this construction are noted in FIGS. 3, 4, and 5, as will be later discussed to secure horn unit 300 to a desired position following assembly.

As will be particularly noted here, housing unit 102' and particularly compressor housing portion 307, containing portions 307A and 307B are initially separable but include pairs of opposing bonding walls 330, 330 which following assembly as noted are thermally welded to each other to permanently and fixably bond portions 307A, 307B in an inseparable manner. Also on opposing bonding walls 330, 330 are a respective series of alignment systems 340, as shown in FIGS. 6, 6A, and 6B. Alignment systems 340 may optionally include a series of extending pins and holes, respectably 341, 342, engagement spring clips and slots 343 (spring clips shown only in FIG. 6A), and alignment and engagement slip ways 344 engaging opposing alignment pins (not shown) on an opposing bonding wall 330.

As will be readily apparent to one of skill in the art having reviewed the present disclosure, during an assembly, compressor 306 is placed within the first shape of housing portion 307A, as shown and aligned employing a series of alignment protuberances 325 on the compressor outer wall (as shown). Thereafter, the opposing are portion of housing portion 307B is positioned and aligned employing any of the alignment systems 340 shown, or any of those understood to those of skill in the art having appreciated the present disclosure, so that opposing bonding walls 330, 330 are in contact along their bonding surfaces. Thereafter, a thermal or radiant bonding is applied along the ranges of bonding walls 330, 330 so as to permanently fix them in position and render compressor unit 306 completely fixed in position within housing 102'. Thereafter, as discussed above, bottom brush housing member 126' is fixably positioned to complete assembly and provide a second locking system to fixably retain compressor unit 306.

Figure 7:
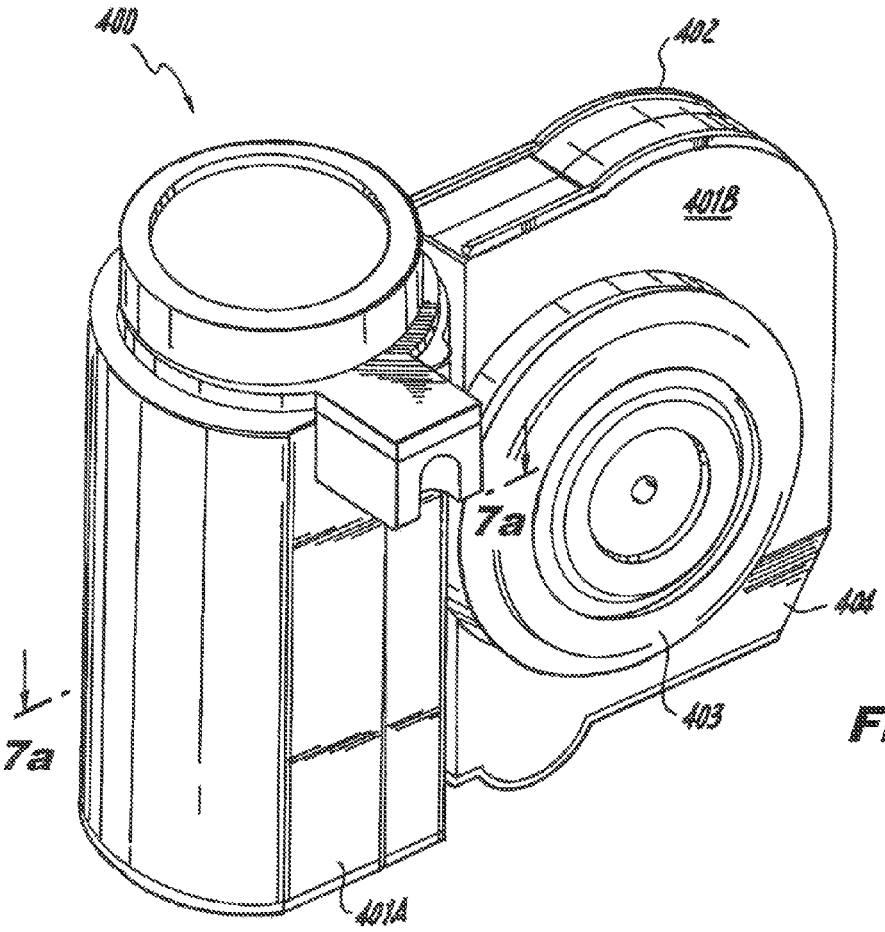
FIG. 7 is a front perspective view of a fourth embodiment of an electric horn system according to the present invention.
Figure 7A:
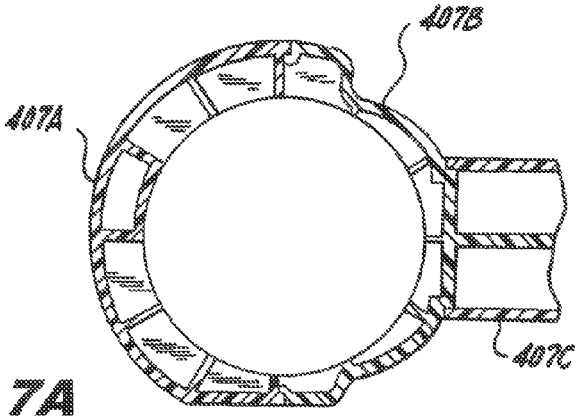
FIG. 7A is a sectional view taken along the line 7A-7A of the electric horn system shown in FIG. 7.
Figure 8:
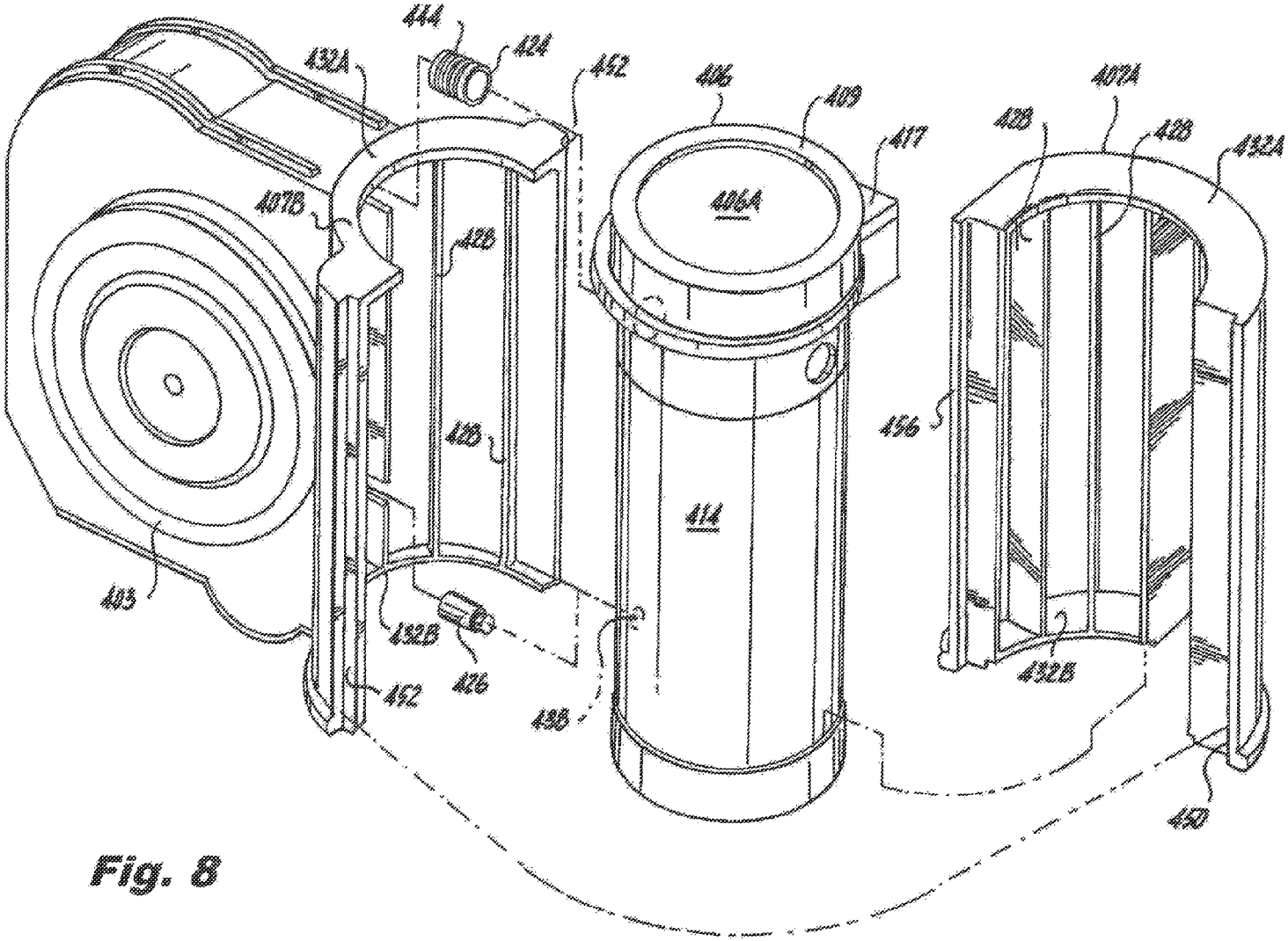
FIG. 8 is an exploded perspective view of the fourth embodiment of an electric horn system shown in FIG. 7.

A fourth embodiment of electropneumatic horn unit 400 is characterized by the compressor unit part 406 being mounted fixedly permanently to the monolithic mounting housing, this embodiment having enhanced operational reliability which contributes to an especially longer service life. Referring to FIGS. 7 and 8, horn unit 400 includes a monolithic housing 402 comprised of an assembly 402 having first and second housing portions 401A, 401B. These two portions include housing parts 407A, 407B and 407C—seen in FIG. 8 before assembly together. In the assembly as depicted in FIG. 7, the part circular housing parts 407A and 407B which comprise the housing first portion, are joined in girding encirclement of compressor unit 406, being permanently joinable together along opposite end edges of each housing part. Housing part 407C serves for mounting diaphragm 403 and constitutes the second housing portion 401B. Housing part 407C is permanently affixed to housing part 407B. A horn opening 404 is provided at a front face of housing part 407C. In the assembly, housing parts 407A, 407B include an opening which defines a cylindraceous reception space for receiving the cylindraceous outer periphery configured electric compressor unit 406. A block 417 for mounting the assembly in use, such as on a vehicle firewall, is carried by and extends outwardly from an upper part of the compressor unit 406.

Figure 9:
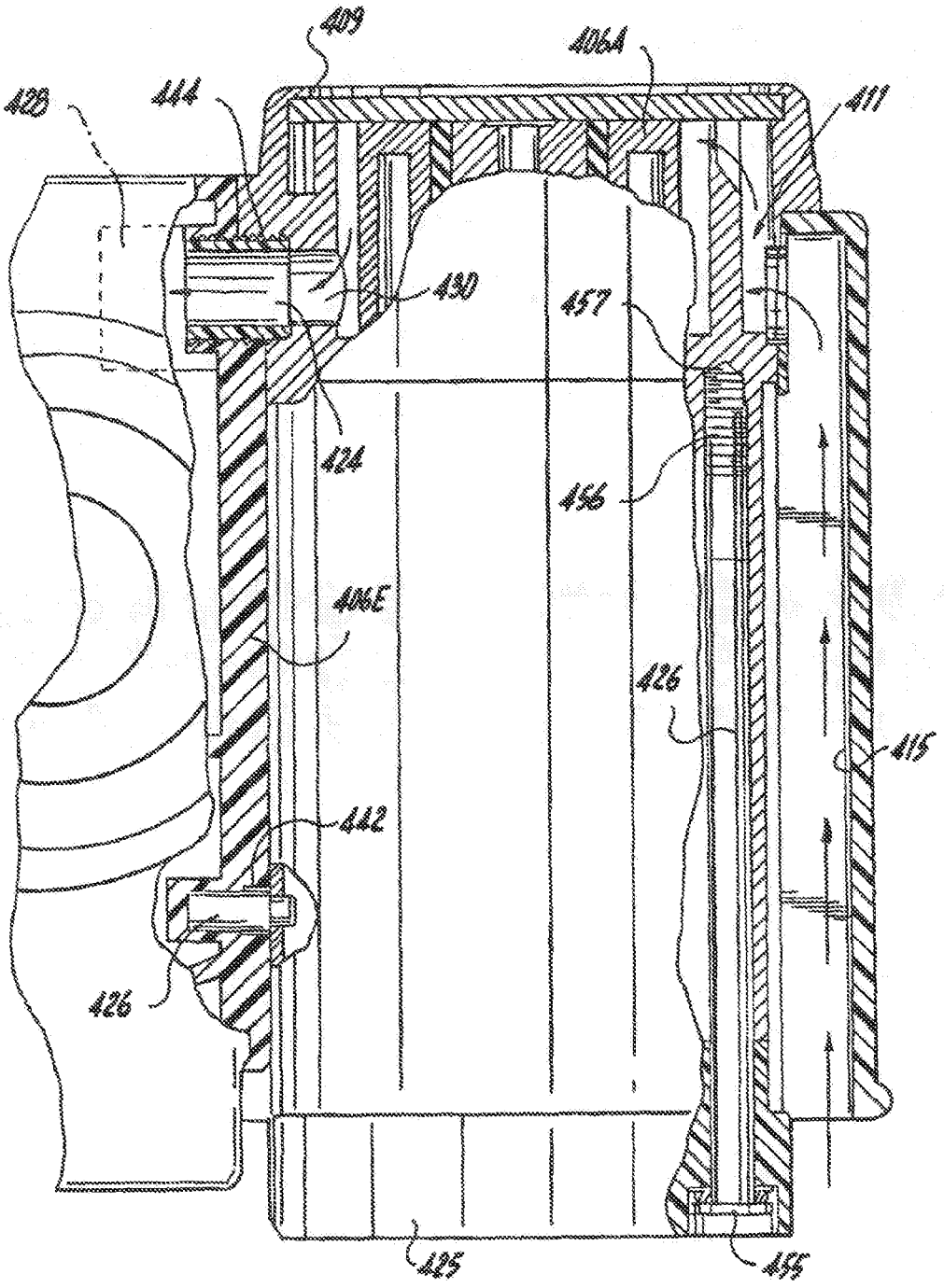
FIG. 9 is a partial view, partly in section, of the fourth embodiment of an electric horn system shown in FIG. 7 depicting the compressor unit mounting to the monolithic housing.

Referring to FIGS. 8 and 9, compressor unit 406 includes a top side part 409 which houses compressor pump member 406A, air intake to which is taken from outside environment through air inlet passage 415 and passes into the pump member through an air inlet 411 thereof, pressurized air outletting the pump member by way of outlet 430. Outlet 430 communicates with a first end of tubular member 424 that is permanently affixed in both the structure of the pump member 406A and in structure segment 407E of housing part 407C. An opposite end of the tubular member communicates with an entry opening 488 leading to at least one acoustic chamber in the housing second portion 401B.

Tubular member 424 has ring like or similar protuberant like structure 444 encircling the outer periphery thereof, this to enable the tubular member to function as an air seal obviating any leakage in and around the region where pressurized air leaves the compressor pump and enters the sound generating structure carried in housing part 407C. The tubular member 424 is fixedly, permanently mounted to structures 406A and 407E. Such fixing can be by a number of ways as, for example, with thermal or radiant bounding, press fitment, as well as others of affixing means effective to the purpose at hand of permanently affixing the tubular member in the assembly.

Carried within housing parts 407A and 407B are fins 428 disposed longitudinally of the respective housing parts and which extend downwardly from the flange pieces 432A at the tops of these housing parts 407A, 407B. The fins 428 at lower ends thereof have joinder to lower flanges pieces 432B. Inner edges of flange pieces 432A, 432B terminate slightly radially outwardly of the inner edges of the fins 428 so that when the assembly is subjected to final affixing tightening, the fins have a slight engagement with the outside of motor housing 414.

Extending downwardly from compressor unit top side part 409 is a motor housing 414 which encircles and is affixed to drive motor structure (not shown) employed to power the compressor pump unit 406A. Motor housing 414 is provided with an opening 438 employed in cooperation with an alignment member 426 to effect necessary and proper registering of longitudinal alignment of the compressor unit with and within the housing structure of the assembled together housing parts 407A, 407B and 407C. It is noted that the inner structure envelope of these housing parts present a cylindraceous receiving profile in correspondence to the like outer configured profile of the compressor unit 406 to be encirclingly received therein. As best seen in FIG. 9, the alignment member 426 is an enlarged cylinder stepped down to smaller cylinder dimension at the front end thereof. The large body part is received in a companion configured pocket part 442 of housing part segment 407E. The alignment member is permanently affixed in the pocket and in the assembled structure, its stepped down front end passes thru opening 438 in the motor housing, this mating assuring that proper housing compressor unit alignment is achieved.

The motor housing 414 compressor unit 406 will be permanently affixed to other structure of the compressor pump unit 406 A other drive motor portions as needed. For that purpose, the locking means such as spring means 115, 127A seen in FIG. 3 or such means 215 in FIG. 5 can be employed. Also, alignment member 428 will be affixed in pocket part 442 of housing segment 407E. Similarly, the tubular member 424 is affixed to the structure of the compressor pump unit 406A. The compressor unit is then juxtaposed with the open face side of housing part segment 407B to align and insert these two members in companion receptive parts of the segment 407E. In effecting this, the tubular member 424 has been inserted in the compressor pump unit in communication with air outlet 430, and the alignment member 426 is passed thru opening 430 in motor housing 414, and housing part 407B partly girds the compressor unit 406. The housing part 407A is then girded about the still ungirded portion of the compressor unit 406. In effecting this girding encirclement of the compressor unit, longitudinal flange extensions 450 on housing part 407A with engage in companion right angle slots 452 on the housing part 407B. The extensions 450 and slots 452 structure having juxtaposed engagement are permanently affixed to each other by thermal or radiant bonding, electric welding, adhesive, or other suitable affixing means.

Figure 10:
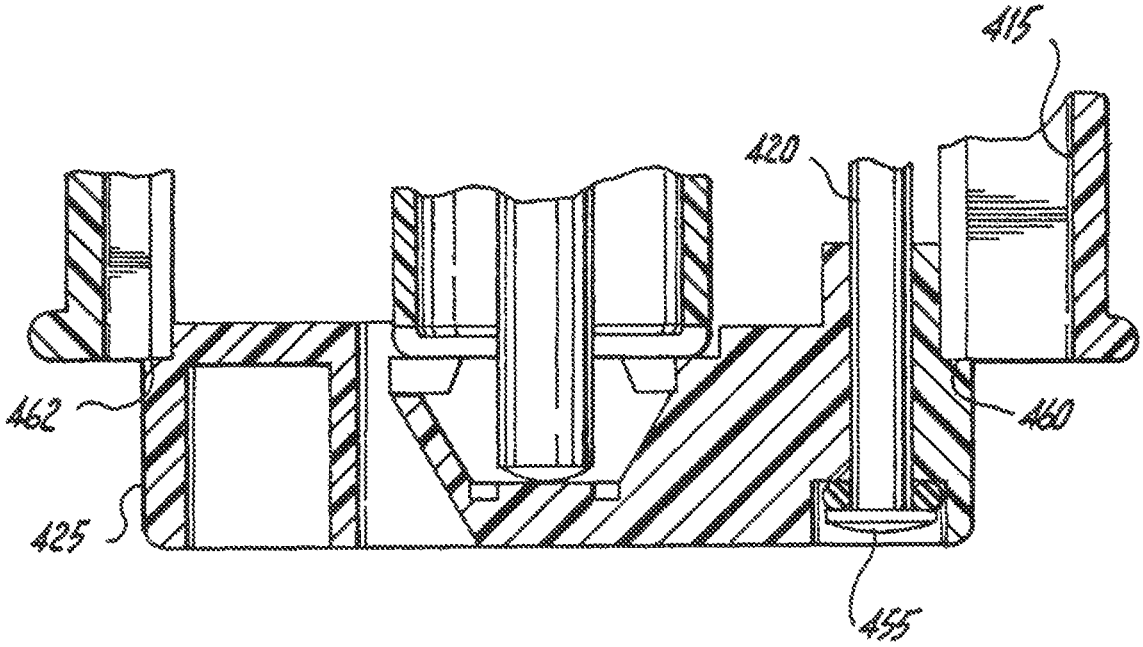
FIG. 10 is a fragmentary sectional view of the electric horn system of FIG. 9 depicting the seal cap mounting attached to the bottom of the compressor unit.

In completing the assembly, additional affixing is made as depicted in FIG. 10. Referring to that Figure, a bottom seal cap 425 similar to the seal cap 225 depicted in FIG. 5, is employed to close off the bottom of the compressor unit 406 and prevents entry of debris or water into the unit 400. The seal cap 425 is affixed to the compressor unit with a pair of elongated bolts 420 which pass up thru bottom seal cap 425, a bolt lower end having a bolt head 455 which stops against structure of the seal cap. An opposite bolt end is threaded as at 456 and this threaded portion is received in a blind threaded bore 457 formed in the structure of the compressor pump unit 406A, the bolts being drawn up tight in the compressor unit structure. In this condition, the lower edge 460 of motor housing 414 sits supported on an encircling ledge face 462 form on the seal cap. In stead of a ledge surface, the seal cap can be formed with a radially, outwardly directed, encircling skirt or flange (not shown in FIGS. 9 and 10) on which the motor housing lower edge 460 would sit.

In accordance with the invention, the components of the horn unit 406 are permanently affixed together; and, it is not possible to remove the compressor unit 406 from the housing structure. This is a result of a number of deterring construction features. Air seal tube 424 and alignment member 426 are affixed in structure of the monolithic housing and the compressor unit 406 in a manner that prevents movement therebetween, as well as preventing entry of debris and water into the unit.

Turning to FIGS. 11-13, demonstrated are several perspective views of the electropneumatic horn 500 showing the air venting channels 510. The horn 500 further comprises an electric compressor unit 506 having a compressor air inlet 513A and a compressor air outlet 513 for the supply of compressed air to a sound or acoustic generator 503 for the ultimate production of sound through horn duct outlets 504. Additionally, the assembly comprises a monolithic housing assembly 502 having a first housing portion embodying an opening defining a space for reception of the compressor unit 506 in the first housing portion 540, and a second housing portion 545 substantially housing a sound wave generator system. Further, the assembly comprises a plurality of air intakes 530 that allow air to be brought along the outer face 512 of the compressor unit 506. The face 512 of the compressor 506, when in use, radiates heat that heats the air moving along the outer face of the compressor 506. The assembly comprises a set of one or more vents 510, embedded in the monolithic housing assembly 502, for venting air from the metal face 512 of the compressor unit 506 for the purpose of reducing air temperature (cooling) across the surface of the compressor assembly 506. This cooling feature prevents burnout of the brushes located in compressor 506, and metal fatigue of the other compressor components.

The horn assembly comprises at least one acoustic chamber having an opening for introduction of compressed air, a membrane member provided with an opening for sound generation, and at least one acoustic duct housed in the housing assembly and communicating between the at least one acoustic chamber and the at least one horn outlet to propagate sound generated by the membrane member outside the horn. There are also air channeling means for communicating between the compressor air outlet of the compressor unit and the opening of the at least one acoustic chamber. The horn assembly further comprises means for permanently affixing the electric compressor unit in the housing assembly whereby the affixing means prevent removal of the electric compressor unit and improves operational stability of the housing assembly.

According to another embodiment of the present invention, there is provided an electropneumatic acoustic horn assembly, comprising a sound wave generator system substantially housed in a monolithic housing assembly and having a monolithic compressor housing portion having a cylindraceous configured receiving opening, and an electric compressor unit 506 being of cylindraceous configuration. The compressor unit 506 has at least a compressor air inlet and a compressor air outlet for the supply of compressed air; and, a set of one or more vents 510, embedded in the monolithic housing assembly 502, for venting air from the metal face 512 of the compressor unit 506 for the purpose of reducing air temperature (cooling) across the surface of the compressor assembly 506. This cooling feature prevents burnout of the brushes located in 110, and metal fatigue of the compressor components. Additionally, the horn 500 comprises means 520 for securing the monolithic housing assembly to an external supporting structure 525.

The means 520 for securing the monolithic housing assembly 502 to an external supporting structure 525 further comprise at least one selected from the following: a protruding mounting bracket member 520; a magnetic mounting member; a suction-based mounting member; an adhesive mounting member; and, a strap mounting member, whereby the means for securing enables ready attachment of the assembly to the external supporting structure.

In FIGS. 14 and 15, there is shown an embodiment of the bracket member which further comprises a top-in or bottom-in receiving member 552 for receiving a securing member 553 such as a screw, a bolt or a pin which can be locked in place by a nut 554, a cotter pin, or a cap; and, having a recessed surface 556 bounded by an edge 558 for allowing the top or bottom end (as the case may be) of the securing member 553 to be flush with or lower than the edge 558. Another embodiment of the bracket member 520 comprises a side-in receiving member 562 for receiving the securing member 553.

Figure 17:
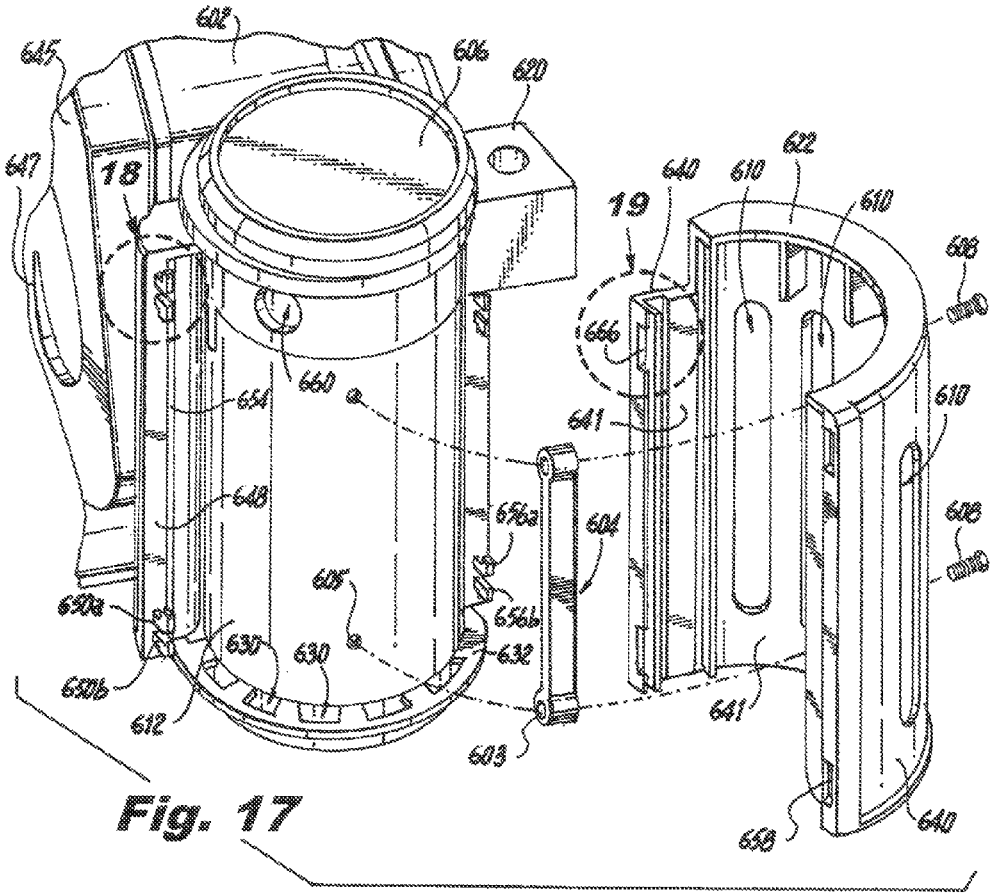
FIG. 17 is a partial exploded perspective view of the electropneumatic horn system of FIG. 16.

Referring next to FIGS. 16 and 17, illustrated are perspective views (FIG. 17 being partially exploded) of the electropneumatic horn 600 according to an alternative embodiment of the present invention further showing, among other things, the external air venting channels 610, spiral-shaped second housing 645, and connectors 604/650 for connecting the cover 622 for the first housing portion 640 to the compressor unit 606. The horn 600 further comprises an electric compressor unit 606 having a compressor air inlet and a compressor air outlet (not shown) for the supply of compressed air to a sound or acoustic generator 603 for the ultimate production of sound through horn duct outlet(s) 601. Additionally, the assembly comprises a monolithic housing assembly 602 having a first housing portion embodying an opening defining a space for reception of the compressor unit 606 in the first housing portion 640, and a second housing portion 645 substantially housing a sound wave generator system. The second housing 645 is preferably of a shape or configuration selected from a spiral configuration, a snail-like shape, a coiled configuration, and the like. Further, the assembly comprises a plurality of air intakes 630 that allow air to be brought along the outer face 612 of the compressor unit 606 and into air intake opening 660 in an upper region of compressor face 612 where the air leads to the sound generator 603. The face 612 of the compressor 606, when in use, radiates heat that heats the air moving along the outer face of the compressor 606. The assembly further comprises a set of one or more vents 610, embedded in the monolithic housing assembly 602, for venting air from the metal outer face 612 of the compressor unit 606 for the purpose of reducing air temperature (cooling) across the surface of the compressor assembly unit 606. This cooling feature prevents burnout of the brushes, and metal fatigue of the compressor components.

As seen more clearly in FIG. 21, to maintain a spacing or air channel 614 between the compressor face and the inner wall 641 of the first housing or cover 640, a connection spacer 604 is preferably employed and securely fastened therebetween using typical engagement means such as screws 608 inserted through a bore throughhole 613 and into a connection hole 505 of compressor face 612. Preferably, cover portion of first housing 640 is removably engaged with a base portion of the first housing 640. Such removable engagement may include on one end a hinge assembly along a first interface between the cover portion and the base portion, and on a second end thereof a removable engagement means such as engagement spring clips 650 *a/b* or 656 *a/b*. When the cover portion is in a closed position (see FIGS. 16 & 20) such that an edge of the cover portion interfaces with an opposing bond wall 648 of the base portion a sealed boding interface 649 is created between seal members 652/654 of the first housing assembly 640. Similarly, a base edge bonding surface 632 of a lower end of the base portion of the first housing 640 interfaces with a tower surface of cover portion 622 to further create a sealed bonding surface therebetween. Preferably, engagement spring clips comprise upper 650 *a*/656 *a* and lower 650 *b*/656 *b* members to engage with an engagement spring clip receiver 658/666.

The horn assembly 600 comprises at least one sound generator or acoustic chamber 603 having an opening for introduction of compressed air, a membrane member provided with an opening for sound generation (see co-pending U.S. application Ser. No. 13/297,955, incorporated herein fully by reference) and at least one acoustic duct having a central portion or region 647 housed in the spiral-shaped second housing assembly 645 and communicating between at least one sound generator or acoustic chamber 603 and at least one horn outlet 601 to propagate sound generated by the membrane member outside the horn. There are also air channeling means for communicating between the compressor air outlet of the compressor unit 606 and the opening of at least one acoustic chamber 603. The horn assembly 600 also comprises means for firmly and securely affixing the electric compressor unit 606 in the first housing assembly 640 whereby the affixing means prevents undesired removal or movement of the electric compressor unit 606 and improves operational stability of the first housing assembly 640.

According to yet another embodiment of the present invention, there is provided an electropneumatic acoustic horn assembly 600, comprising a sound wave generator system 603 substantially housed in or on a monolithic housing assembly 645 and having a compressor housing portion 640 having a generally cylindraceous or semi-cylindraceous configured receiving opening, and an electric compressor unit 606 having a generally cylindraceous configuration. The compressor unit 606 has at least a compressor air inlet and a compressor air outlet for the supply of compressed air; and, a set of one or more vents 610, embedded in the first housing assembly 640, for venting air from the outer face 612 (which may be made of metal) of the compressor unit 606 for the purpose of reducing air temperature (cooling) across the surface of the compressor assembly 606. This cooling feature prevents burnout of the brushes and metal fatigue of the compressor 606 components. Additionally, the horn 600 comprises means 620 for securing the monolithic housing assembly to an external supporting structure (not shown). The means for securing the monolithic housing assembly 602 to an external supporting structure further comprise at least one selected from a protruding mounting bracket, a magnetic mounting member, a suction-based mounting member, an adhesive mounting member, and a strap mounting member, where the means for securing enables ready attachment of the assembly 600 to the external supporting structure.

Figure 18:
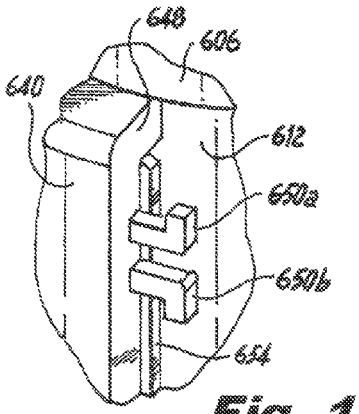
FIG. 18 is a close up view of an embodiment of the engagement spring clip between the first bonding surfaces of the housing portions shown in FIG. 17.
Figure 19:
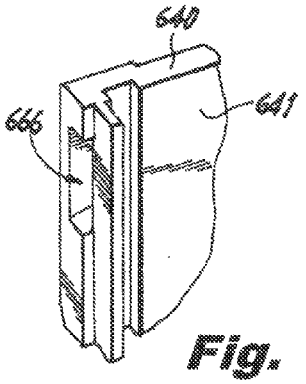
FIG. 19 is a close up view of an embodiment of the spacer and air channel between the compressor face and the first housing portion shown in FIG. 17.

Turning next to FIGS. 18-20, shown is an embodiment of a bracket member or engagement member comprising on a base portion of the housing 640 a spring clip having upper 650*a* and lower 650*b* engagement members for engagement with a receiving member 666. Such an engagement is removably secured and provides sealed bonding interface 649 between the cover portion 622 and the base portion of the housing 640. As depicted in FIG. 17, this type of engagement spring clip 650*a/b* or 656*a/b* may be employed on a plurality of connection surfaces between the cover portion 622 and the base portion of housing 640. Optionally, one side of the interface between the cover 622 and the base may use a hinge assembly or other connection means to hold the cover 622 together with the base in a movable manner. It is important that the cover 622 be removable with respect to the base portion of the housing 640 such that the compressor may be access for cleaning and or removal or replacement. Also optional is an attachment member 620 for attaching the electropneumatic horn 600 to an external structure for mounting in a rigid or semi-rigid manner during use.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An electropneumatic horn assembly for generating sound, wherein said horn assembly comprises:

a compressor unit to provide a supply of compressed air, said compressor unit having a compressor air inlet and a compressor air outlet;

a compressor housing assembly having a base portion and a movable cover portion, said housing assembly embodying an opening defining a space for reception of said compressor unit, said cover portion movably engaged with said base portion to provide access to said compressor when in an open position and to provide a sealed bonding interface when in a closed position; and a sound generating assembly comprising a diaphragm and a horn duct housing;

wherein a plurality of vents are embedded in said cover portion for venting air adjacent an outer face of said compressor unit;

wherein a rigidly secured spacer having a width is positioned between and secured to an inner wall of said cover portion and said outer face of said compressor unit to provide an air channel therebetween by maintaining a space corresponding to the width of the spacer, the spacer extending in a direction along an axis extending along lengths of the inner wall and the cover portion; and wherein said cover portion and said base portion comprise respective irremovable engagement means including upper and lower spring clips and a receiver that engages the spring clips for securely affixing said cover portion to said base portion around said compressor unit to maintain operational stability of said horn assembly.

2. The horn assembly according to claim 1, further comprising:

a connecting element positioned between said cover and said outer face of said compressor unit.

3. The horn assembly according to claim 1, wherein said horn duct housing has a spiral-like configuration.

4. The horn assembly according to claim 1, further comprising:

at least one connecting device positioned on an inner wall of said cover portion for securing said cover to said compressor unit.

5. The horn assembly according to claim 1, wherein said cover portion comprises connectors for engaging end portions of said base portion to secure said cover in a closed position.

6. The horn assembly according to claim 5, wherein said connectors are selected from the group consisting of adhesives, screws, hinges, spring clips, magnets, hooks, and hook-and-loop fasteners.

7. The horn assembly according to claim 1, wherein said compressor unit comprises an air intake opening for receiving air.

8. The horn assembly according to claim 1, wherein a lower end of said base portion comprises a plurality of openings for receiving air.

9. An electropneumatic acoustic horn assembly for generating sound, wherein said horn assembly comprises:

a monolithic housing assembly having a compressor housing portion having a cylindraceous configured receiving opening, wherein said housing assembly includes an attachment member for interconnection to an external support structure;

an electric compressor unit being of cylindraceous configuration and having a compressor member, an opposing end to said compressor member, and at least a compressor air inlet to receive air and a compressor air outlet to supply compressed air;

a sound wave generator system substantially housed in said monolithic housing assembly, wherein said generator system generates sound upon receipt of compressed air from said compressor unit; and an attachment member for securing said horn assembly to an external supporting structure;

wherein a rigidly secured spacing element having a width is positioned between and secured to an inner wall of said monolithic housing assembly and an outer face of said compressor unit and lengthwise with respect to the compressor housing portion; and wherein said compressor housing portion includes a plurality of vents embedded in said compressor housing portion for venting air from an outer face of said compressor unit to reduce air temperature across said outer face.

10. The horn assembly according to claim 9, further comprising:

means for removably affixing said compressor unit in said housing portion, wherein said means for affixing elastically engages and removably affixes said compressor unit with said housing portion and maintains operational stability of said housing.

11. The horn assembly according to claim 10, wherein said means for affixing said compressor unit with said monolithic housing further comprises at least one selected from the group consisting of adhesives, screws, hinges, spring clips, magnets, hooks, and hook-and-loop fasteners.

12. The horn assembly according to claim 11, wherein said means for affixing further comprises alignment pins for aligning said inner housing.

13. The horn assembly according to claim 9, wherein said attachment member is selected from the group consisting of brackets, screws, rivets, clamps, lugnuts, wingnuts, and bolts.

14. The horn assembly according to claim 9, in which said compressor unit embodies an air compressor pump at a top end thereof, said compressor unit having a bottom end opening, and means for sealing said bottom end to minimize an entry of debris and water into said housing assembly through said air compressor bottom end.

15. The horn assembly according to claim 9, wherein said sound generator system further comprises:

an acoustic chamber formed between an inner housing member and an outer housing member, said chamber having an opening for the introduction of pressurized air;

a membrane member removably positioned between said inner housing member and said outer housing member; and air channeling means for communicating between said opening of said acoustic chamber and an air outlet of an electric compressor unit for said horn assembly.

16. The horn assembly according to claim 15, wherein said membrane member is provided with an opening for sound generation and at least one acoustic duct housed in a housing assembly and communicating between said acoustic chamber and at least one horn outlet to propagate sound generated by said membrane member outside said horn.

17. The assembly according to claim 16, wherein said membrane member is positioned with lateral seal between said inner housing member and said outer housing member.

* * * * *